US010794023B2

(12) United States Patent
Allington et al.

(10) Patent No.: US 10,794,023 B2
(45) Date of Patent: Oct. 6, 2020

(54) BARRIER SYSTEM

(71) Applicant: Holmes Solutions Limited Partnership, Wellington (NZ)

(72) Inventors: Christopher James Allington, Wellington (NZ); Andrew Karl Diehl, Wellington (NZ); Andrew Sarratt, Wellington (NZ); Emerson Ryder, Wellington (NZ); Ken Readman, Wellington (NZ); Nathan King, Wellington (NZ)

(73) Assignee: Holmes Solutions LP, Wellington (NZ)

( * ) Notice: Subject to any disclaimer, the term of this patent is extended or adjusted under 35 U.S.C. 154(b) by 0 days.

(21) Appl. No.: 16/092,189

(22) PCT Filed: Apr. 7, 2017

(86) PCT No.: PCT/NZ2017/050041
§ 371 (c)(1),
(2) Date: Oct. 8, 2018

(87) PCT Pub. No.: WO2017/176130
PCT Pub. Date: Oct. 12, 2017

(65) Prior Publication Data

US 2019/0145070 A1 May 16, 2019

(30) Foreign Application Priority Data

Apr. 8, 2016 (NZ) ..... 718757

(51) Int. Cl.
*E01F 15/04* (2006.01)
*E01F 15/00* (2006.01)

(52) U.S. Cl.
CPC ..... *E01F 15/0461* (2013.01); *E01F 15/0423* (2013.01)

(58) Field of Classification Search
CPC . E01F 15/146; E01F 15/0453; E01F 15/1461; E01F 15/086; E01F 15/0484;
(Continued)

(56) References Cited

U.S. PATENT DOCUMENTS 5,044,609 A * 9/1991 Cicinnati ..... E01F 15/04 256/13.1
6,173,943 B1 * 1/2001 Welch ..... E01F 15/143 256/13.1
(Continued)

OTHER PUBLICATIONS

International Search Report and Written Opinion for PCT/NZ2017/050041 filed Apr. 7, 2017, dated Jul. 10, 2017 from the Australian Patent Office International Searching Authority, 8 pages.
(Continued)

*Primary Examiner* — Abigail A Risic
(74) *Attorney, Agent, or Firm* — Holzer Patel Drennan

(57) ABSTRACT

A longitudinal beam barrier system comprises a longitudinal beam and a post linked together via a fastener incorporating at least one deformable washer. The link is made in a releasable and tunable manner dependent on an applied force via the at least one deformable washer. Release may be made dependent on both the magnitude and direction of the force so that release may be a result of different release forces in different force angles. The deformable washer may be designed to transfer a longitudinal beam load force from a fastener to a post wall, the washer extending around the fastener and having a first face that bears on the fastener or a part thereof (or forms part of the fastener) and an opposing face that at least partly bears on a part of the post wall or walls. The washer is designed so that, in the event of an impact of sufficient force on the longitudinal beam, post, or fastener, the washer at least partly deforms allowing separation to occur between the post or posts and the longitudinal beam.

35 Claims, 11 Drawing Sheets

(58) Field of Classification Search
CPC ..... E01F 15/0423; E01F 15/02; E01F 15/025; E01F 15/04; E01F 15/0407; E01F 15/0415; E01F 15/0438; E01F 15/0461; E01F 15/08; E01F 15/088; E01F 15/145
See application file for complete search history.

(56) References Cited

U.S. PATENT DOCUMENTS

| | | | | |
|---|---|---|---|---|
| 6,234,437 | B1 * | 5/2001 | Cabo | E01F 15/0461 248/200 |
| 7,878,486 | B2 * | 2/2011 | Ochoa | E01F 15/0423 256/13.1 |
| 8,353,499 | B2 * | 1/2013 | Conway | E01F 15/0423 256/13.1 |
| 8,960,647 | B2 | 2/2015 | Wallace | |
| 9,200,417 | B2 * | 12/2015 | Leonhardt | E01F 15/0461 |
| 9,217,230 | B2 | 12/2015 | Wallace | |
| 9,863,106 | B2 * | 1/2018 | Conway | E01F 15/0423 |
| 10,329,722 | B2 * | 6/2019 | Colquhoun | E01F 9/619 |
| 2006/0011900 | A1 * | 1/2006 | Ochoa | E01F 15/0423 256/13.1 |
| 2008/0067484 | A1 * | 3/2008 | Amengual Pericas | E01F 15/043 256/13.1 |
| 2008/0083914 | A1 * | 4/2008 | Ochoa | E01F 15/0423 256/13.1 |
| 2008/0230759 | A1 * | 9/2008 | Lass | E01F 15/0438 256/13.1 |
| 2009/0050863 | A1 * | 2/2009 | Conway | E01F 15/0423 256/13.1 |
| 2009/0050864 | A1 * | 2/2009 | Conway | E01F 15/0423 256/13.1 |
| 2009/0279950 | A1 * | 11/2009 | Amengual Pericas | E01F 15/0438 404/10 |
| 2011/0084246 | A1 * | 4/2011 | Amengual Pericas | E01F 15/0423 256/13.1 |
| 2012/0003039 | A1 * | 1/2012 | Wallace | E01F 15/0423 404/6 |
| 2014/0145132 | A1 * | 5/2014 | Leonhardt | E01F 15/0423 256/13.1 |
| 2014/0319441 | A1 * | 10/2014 | Conway | E01F 15/0423 256/13.1 |
| 2015/0014617 | A1 | 1/2015 | Wallace | |
| 2015/0129822 | A1 * | 5/2015 | Wallace | E01F 15/0423 256/13.1 |
| 2016/0237633 | A1 * | 8/2016 | Wallace | E01F 15/0461 |

OTHER PUBLICATIONS

International Preliminary Report on Patentability for PCT/NZ2017/050041 filed Apr. 7, 2017, dated Jul. 26, 2018 from the Australian Patent Office International Searching Authority, 18 pages.

* cited by examiner

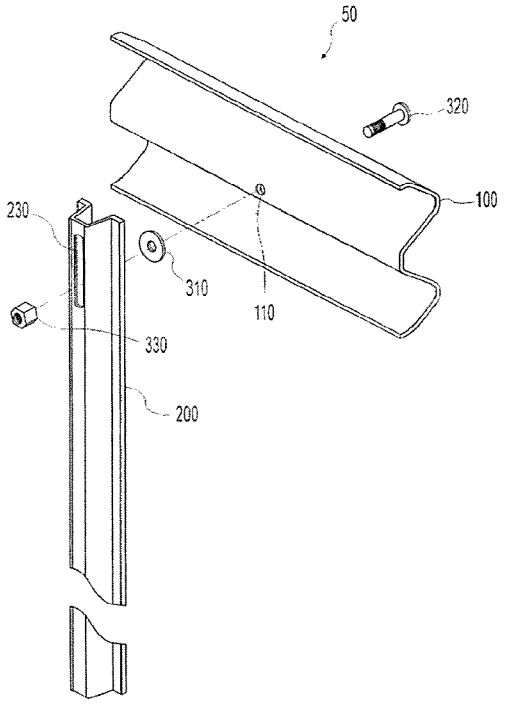
FIGURE 4 – PRIOR ART
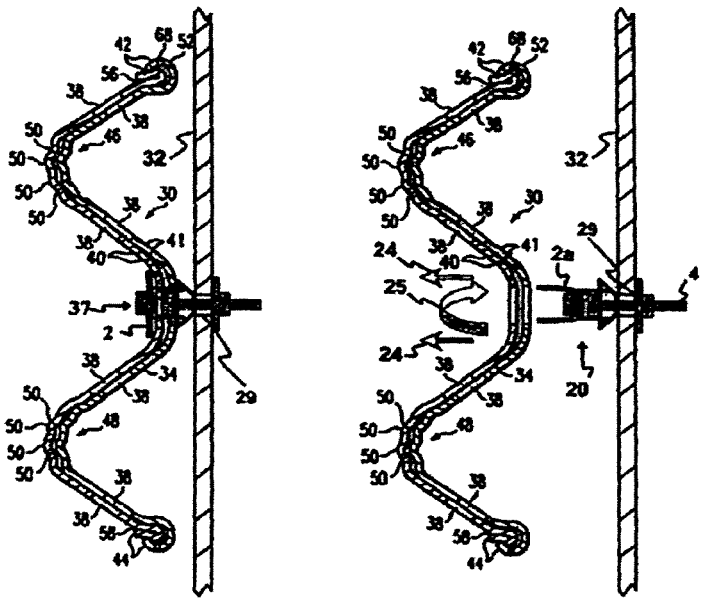
FIGURE 5 – PRIOR ART

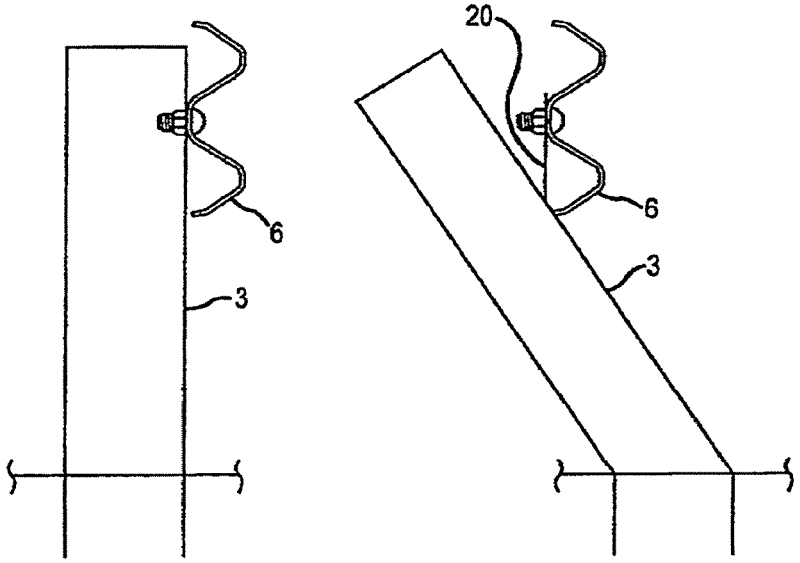
FIGURE 6 – PRIOR ART
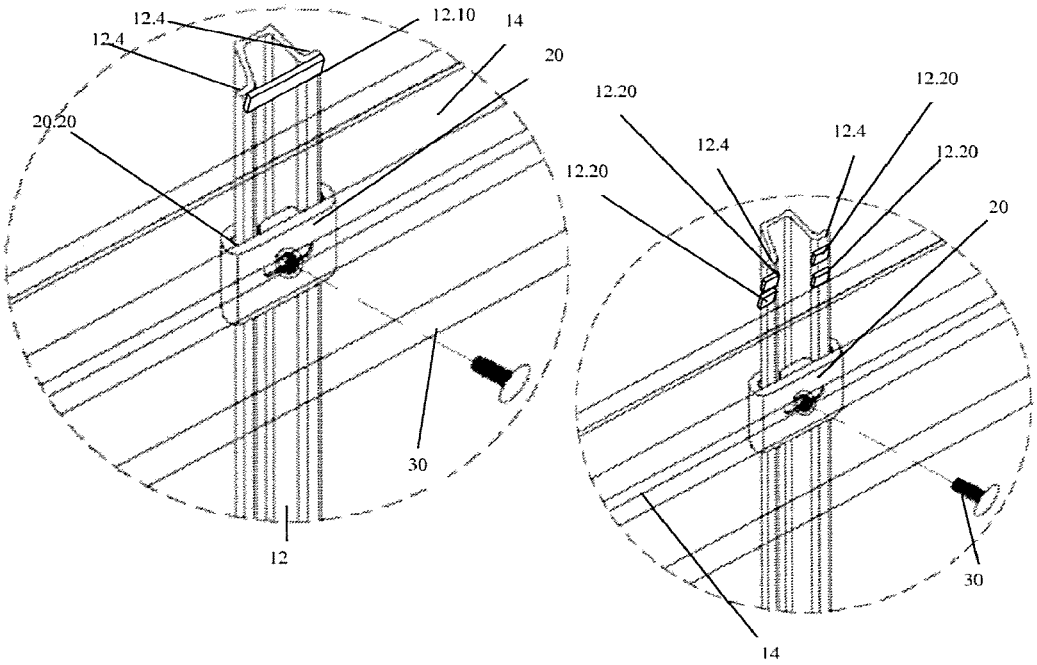
FIGURE 7 – PRIOR ART

BARRIER SYSTEM

RELATED APPLICATIONS

This application derives priority from New Zealand patent application number 718757 incorporated herein by reference.

TECHNICAL FIELD

Described herein is a barrier system. More specifically, a barrier system is described using a longitudinal beam and post design with a tunable fastening means.

BACKGROUND ART

Barrier systems typically comprise of an elongated longitudinal beam element that is typically located in a near parallel orientation with the ground. The longitudinal beam is supported at a defined height by a series of discrete near vertical (perpendicular to the ground) posts. The posts are located at discrete distances along the length of the longitudinal beam. Most commonly, the posts are installed directly into the soil but equally the posts can be installed onto the surface of a more rigid medium (concrete or asphaltic-concrete). A first connection is formed at the intersection between the post and the longitudinal beam and a second connection is located between the ground, or more rigid medium, and post. This first connection is required to provide support for the longitudinal beam in most circumstances but allow the longitudinal beam to separate from the posts in a controlled and repeatable manner when impacted by an errant vehicle. The second connection is required to give stability to the post during normal retention and to react in a predetermined manner in the even of an impact. In both the first and second connection cases above, a force dependent retention and release system may be used. Equally, a retention system that releases upon a controlled displacement may also be used.

When installed as a roadside barrier, the system is required to have sufficient strength and stiffness to be able to be installed and to remain rigidly in place under a variety of weather conditions. Fundamentally the posts and connection detail must provide sufficient vertical support to the longitudinal beam to maintain its height relative the ground. However the system must also be able to withstand variations in temperature whereby the longitudinal beam (elongated tension element) can expand during hot temperatures and contract during colder weather, resulting in a longitudinal movement in the rail. The strength and stiffness of the posts and the connection detail between the posts and the longitudinal beam must be able to accommodate this lateral (longitudinal along the length of the barrier) movement.

During the installation process the system must have sufficient tolerance for vertical and horizontal misalignment of the connection detail to allow the posts to be joined to the longitudinal beam. For a conventional installation this may require up to ±25 mm in all directions. The connection detail must also allow for angular misalignment of the connection point.

The primary purpose of the system as a roadside barrier is to protect the occupants of the vehicle from a roadside hazard and to protect other road users from the vehicle should it become errant. To operate as desired, it is required to contain and then redirect an errant vehicle when impacting the barrier. When an errant vehicle impacts the barrier it can be a violent and dynamic impact resulting in damage to both the barrier and the vehicle. As such it is required that the design of the barrier system can accommodate this violent impact and function as intended without causing harm to the vehicle occupants or other road users.

When a vehicle impacts a longitudinal beam, the vehicle forces the longitudinal beam to deflect backwards away from the vehicle approach path. This movement causes the barrier to increase in length between an end anchorage or between near rigid end anchorages which in turn places tension into the longitudinal beam (due to the required increase in the length to accommodate the deflection). This tension force is often called "ribbon tension" and it is this tension which helps the longitudinal beam to redirect the vehicle along the face of the barrier and to prevent it from hitting the hazard that the barrier is protecting. In a typical high speed crash the ribbon tension on the barrier is sufficient that it causes the longitudinal beam to plastically deform, permanently changing both the shape and mechanical properties of the beam.

Due to the length of barrier required to protect the vehicle from a hazard, the longitudinal beam element is typically manufactured from a series of shorter length sections that are joined at regular intervals to form the full length of the barrier. Typically each length of longitudinal beam is up to 4 m long although longer segments may be used. As the result of the high tension force that occur in the longitudinal beam during an impact, it is preferable to limit any additional stresses or strains in the barrier that could form zones of weakness, as these can cause the longitudinal beam to rupture or tear. Most commonly the location of the joins in the longitudinal beam (often called a splice joint) are weaker or have higher stresses than the other sections of the longitudinal beam and if failure of the longitudinal beam is observed it commonly occurs at these locations. Furthermore, the location of the joints (splices) is typically located at a post location. Therefore it is important to ensure that the connection between the longitudinal beam and the post limits any additional stresses placed into the longitudinal beam so as to limit the potential for failure at this location.

As noted above, in a physical crash, the longitudinal beam is required to deflect backwards by the errant vehicle. This backward motion of the longitudinal beam forces the posts which are attached to the longitudinal beam to also rotate backward. As the posts hinge backwards the height of the connection with the longitudinal beam above the ground level will reduce, due to the geometry of the motion. As the height of the connection with the longitudinal beam drops it will force the longitudinal beam to drop as well. If the height of the longitudinal beam becomes too low relative to the centre of gravity of the vehicle the impacting vehicle has the potential to override the barrier causing a hazard to the vehicle occupants and other road users. It is therefore critically important to limit the potential for downward motion of the longitudinal beam during an impact.

The downward motion of the longitudinal beam can be limited in a variety of manners:

Placing an off-stand (typically called a block-out) on the front of the posts (see FIG. 1) alters the geometry such that when the posts rotate backwards the desired height of the longitudinal beam is maintained for a greater degree of rotational angle. The downside to using block-outs is that the width of the system increases and therefore the width of the road corridor must also be increased to avoid constricting the space allowable for the vehicle. There is a considerable advantage in using a narrow barrier system.

If under an impact, the base of the post can move backwards in a similar manner to the top. This forces the posts to deflect laterally rather than rotate (see FIG. 2). This form of motion is most easily achieved by fracturing or breaking the post at or near the ground level separating the connection between the post and the ground. The key issue with this method is the potential for the fractured, broken, or separated post to form a hazard to other road users as it deflects backwards.

The connection detail used to join the longitudinal beam and the posts can be designed so as to allow the two components to separate when impacted (see FIG. 3). This allows the longitudinal beam to move upward relative to the post as it rotates backwards. This method has a considerable number of advantages if it is controlled correctly but this is very difficult to achieve.

A number of w-beam barrier systems have been developed and patented based on each of the above features. Although all of the art systems try to achieve a similar performance there are a number of manners in which this can be achieved, and various technologies available which provide benefits and trade-offs to certain aspects of the system performance. Four systems are described below by way of illustration.

U.S. Pat. No. 8,353,499 describes a system using a vertical slot in the front face of a U-channel which is used to form the connection between the longitudinal beam and the post (see FIG. 4 for a drawing of this design). The slot allows the connection with the longitudinal beam to move upward relative to the post as the post rotates backwards. At the top of the slot there is material bridging the top of the slot. When the fastener used in the connection reaches the top of the slot it is forced to fracture through this bridge in order to separate the longitudinal beam from the post. The force required to achieve this fracture must be carefully controlled; if the force is too little then the longitudinal beam can separate early, if the force is too high then the longitudinal beam will stay attached too long and be dragged downward as the post rotates backward.

A further drawback of this system is that there may be a fine tolerance for the degree of fastener tightening. Too loose and the parts may detach prematurely. Too tight and the rail sliding movement may be impacted potentially causing the rail to be drawn down with the post due to the additional friction or clamping force created between the post and the beam.

The key benefit of this system is that it allows for vertical movement between the post and the longitudinal beam and it creates a vertical release of the connection, however it does not allow the post to separate from the longitudinal beam in any other manner or direction of loading and therefore does not address the issues of releasing when the force perpendicular to the face of the post is sufficiently large, releasing due to twisting of the post, or the beam moving laterally or downwards.

The system is only described for use with U-shaped posts and is very specific to the properties of the post. Due to this limitation, the system cannot be installed with a longitudinal beam on both sides of the post (back-to-back or median installation). The system is also difficult to install due to the dimensions of the bridge at the top of the slot. This bridge is required to be small to limit the strength to ensure release occurs, and therefore because it is small it is prone to being damaged when installed into the ground, particularly since the majority of the posts are driven into the ground by being pounded using a falling weight onto the top surface. Any damage to this bridge can critically alter the manner in which the release mechanism occurs.

U.S. Pat. No. 7,878,486 describes a system operated by using a smaller diameter fastener than intended for the size slot in the longitudinal beam element such that the head of the fastener can move directly through the slot in the longitudinal beam. FIG. 5 illustrates this art design. A deformable washer is placed under the head of the fastener to prevent the fastener from falling through the slot. A series of cup shaped washers are then installed between the longitudinal beam and the posts to provide the required seating between the post and the longitudinal beam.

During an impact as the posts rotate backward, a tension load is placed onto the fastener. When the tension load reaches the desired level (defined by the properties of the deformable washer) the edges of the washer deform and allow the longitudinal beam to separate from the post by the fastener pulling directly through the longitudinal beam element.

This system has no vertical tolerance. As the posts rotate backwards, the longitudinal beam is forced to travel down with the posts until such time that the tension force on the fastener exceeds the capacity of the washer. This form of release is prone to error and has the potential to drag the longitudinal beam downward if the properties of the washer are inconsistent or the placement of the washer is varied. By way of example, if the washer is located towards the middle of the slot it is apparent that it is required to deform less (to a lower force) than if the washer is located at either end of the slot where additional material is required to be deformed (thereby requiring a higher force). Additionally, if the fastener is installed to the edge of the slot in the beam, then the head of the faster is allowed to overlap with the material in the front face of the beam. In this configuration the washer cannot deform as it is constrained between the head of the fastener and the beam, rendering the unsuitable for use.

Installation of this system can also be difficult with numerous washers and spacers required to be installed, particular between the post and the longitudinal beam. If any component is not installed (or incorrectly installed) then the system performance will be significantly compromised. Concern also arises if the system is installed with a different washer which would significantly alter the performance of the system.

U.S. Pat. Nos. 8,960,647 and 9,217,230 operate by use of a deformable tab system formed integrally in the post. The tab is designed to hinge away from the post as the post rotates backwards, with the hinge formed at the base of the tab (see FIG. 6 for an illustration of this art design). The top of the tab is connected to the post with a series of shear tabs that are designed to fracture under a predefined tension load and allow the tab to rotate. At the desired degree of post rotation the hinges at the bottom of the tab are also designed to fracture allowing the tab to break free from the post and allowing the longitudinal beam to separate from the post.

A key benefit of the system is described as being the simplicity of the connection. It does not require any additional components and can be formed with conventional fasteners. However, obtaining the correct performance of the system is difficult as there is insufficient difference between the force imparted on the tabs when holding the tab into the post under normal conditions and the forces which the tab must break under during an impact from a vehicle. Experience has shown that this can be difficult to achieve with insufficient tolerance between the forces obtained during an installation and those during an impact. Key issues with installations include the ability of the tabs to provide sufficient strength in a direction perpendicular to the post when the longitudinal beam is required to be installed around a convex curved where a high tension force perpendicular to the face of the post can be generated.

Further, when a post is driven into the ground there can be a high vibration force placed into the post. This vibration force has the potential to damage the connection with the tab. If this tab is damaged, the entire post is required to be replaced which is time consuming and expensive. Further, if the damage is not readily identifiable, the post may remain installed in the barrier system with consequent impact performance of the system being compromised.

US2015/0014617 describes a system that operates by connecting the longitudinal beam to the post via a slider system, a drawing of this design illustrated in FIG. 7. This slider fits around the post and is relatively free to move up and down the front face of the post. As the posts rotate backwards the slider moves up the face of the posts and ultimately comes free from the top of the post. As the system is relatively free sliding (with the exception of friction in the system) a series of tabs are included on the face of the posts. These tabs interfere with the fastener used to connect the longitudinal beam to the post to provide some resistance to vertical movement.

A key issue with the system described in the '617 application is that the sliders are required to be inserted over the top of the posts and then are required to release from the top of the posts. Any damage that occurs to the top of the posts during the installation of the posts into substrate can prevent the sliders from being installed. Likewise, if the top of the posts are damaged during an impact then the sliders may not release in a consistent manner (or release at all) and result in the longitudinal beam being dragged downward with the posts. Additionally, if the fastener is not tightened to the full extent of the thread then it will not interfere fully with the tabs and will alter the release force of the system, The system described in the '617 application can only be installed on posts with a symmetric cross section. This limits the usefulness of the system.

As should be appreciated from the above, art barrier systems may have drawbacks such as bespoke parts, difficult installation and lack of tunability. It would therefore be useful to address at least some of the art drawbacks or at least provide the public with a choice.

Further aspects and advantages of the barrier system will become apparent from the ensuing description that is given by way of example only.

SUMMARY

Described herein is a longitudinal beam barrier system that comprises a longitudinal beam and a post linked together via a fastener incorporating at least one deformable washer. The deformable washer may be designed to transfer a longitudinal beam load force or an applied displacement from a fastener to a post wall, the washer extending around the fastener and having a first face that bears on the fastener or a part thereof (or forms part of the fastener) and an opposing face that at least partly bears on a part of the post wall or walls. The washer is designed so that, in the event of an imposed force of sufficient magnitude or an imposed displacement of a sufficient magnitude on the longitudinal beam, post or fastener, the washer at least partly deforms allowing the longitudinal beam and post to separate.

In a first aspect, there is provided a barrier system comprising at least one post and a longitudinal beam, the at least one post and longitudinal beam being indirectly linked via at least one fastener and at least one washer wherein the at least one washer comprises:

- at least one aperture that receives the at least one fastener therethrough; and
- at least one deformable region extending at least partly about the aperture that at least partially bears on at least a part of the at least one fastener and an opposing face that bears on at least part of a post wall; and,
- in the event of an applied force or a displacement being applied on the longitudinal beam or fastener of sufficient magnitude, at least part of the at least one deformable region of the at least one washer deforms to an extent that the indirect link ceases to provide indirect attachment between the post and longitudinal beam, thereby releasing or loosening the connection between the post and longitudinal beam.

In a second aspect there is provided a barrier system post, at least one fastener and at least one washer wherein the at least one washer comprises:

- at least one aperture that receives the at least one fastener therethrough; and
- at least one deformable region extending at least partly about the aperture that at least partially bears on at least a part of the at least one fastener and an opposing face that bears on at least part of a post wall; and,
- in the event of an applied force or a displacement being applied on the barrier system post of sufficient magnitude, at least part of the at least one deformable region of the at least one washer deforms to an extent that the indirect link ceases to provide indirect attachment of the post and fastener, thereby releasing or loosening the connection between the post and at least one fastener.

In a third aspect there is provided at least one washer for use in a barrier system comprising:

- at least one aperture that is sufficiently large to receive at least one fastener therethrough; and
- at least one deformable region extending at least partly about the aperture that is sized to at least partially bear on either or both of at least a part of the at least one fastener and at least part of a barrier post; and,
- in the event of a loading or an applied displacement on the barrier system of sufficient magnitude, at least part of the at least one deformable region of the at least one washer deforms to an extent that the bearing face or faces are substantially removed.

In a fourth aspect, there is provided the use of at least one washer substantially as described above in the manufacture of a barrier system.

In a fifth aspect there is provided a method of arresting or re-directing the path of movement of a vehicle by the step of installing a barrier system substantially as described above.

As may be appreciated, the above described barrier system may provide a variety of advantages. Some examples include:

(a) The barrier achieves the basic requirements of absorbing at least one force applied on the barrier and redirecting vehicles yet not redirecting too far or in a way that minimises the risk of causing a further hazard;

(b) The design minimises both the number of parts necessary and minimises the need for use of any bespoke or unique parts—in some embodiments the design might only require standard art shaped longitudinal beams, posts and fasteners with specially designed (but low material content, washers as described above). This therefore reduces expense, complexity, transport costs and makes installation simple and fast;

(c) The design allows for a variety of aspects to be tuned prior to installation therefore making the barrier more versatile;

(d) Failure on impact is predictable and reproducible;

(e) In the event of an impact on the barrier, undamaged posts and beams can easily be reassembled by inserting a new washer;

(f) There is little sensitivity in fastener positioning hence the design is easier to install and less prone to failure;

(g) The link between the post and longitudinal beam has no interaction with the top of the post. This means that any damage to the post on installation does not alter the connection and performance on impact of the barrier system;

(h) Movement of the fastener relative to the post and/or longitudinal beam can be allowed for in the design thereby catering also for climate caused changes in position (such as hot or cold weather causing expansion and contraction) and minor impacts where capture and re-direction is unnecessary;

(i) The design also minimises any stress points on the longitudinal beam ensuring that the beam does not fail in the event of an impact;

(j) The system can translate one form of motion or force vector which does not apply a sufficient force to the washer to cause deformation into a second force vector or motion which does apply a force of sufficient strength to deform a region on the washer. Equally, the system can be constructed to undertake the opposite, thereby changing the motion or applied force so as to reduce the deformable load applied to the washer.

BRIEF DESCRIPTION OF THE DRAWINGS

Further aspects of the barrier system will become apparent from the following description that is given by way of example only and with reference to the accompanying drawings in which:

FIG. 4 illustrates a prior art design;

FIG. 5 illustrates an alternative prior art design;

FIG. 6 illustrates a further alternative prior art design;

FIG. 7 illustrates a further alternative prior art design;

DETAILED DESCRIPTION

Figure 1:
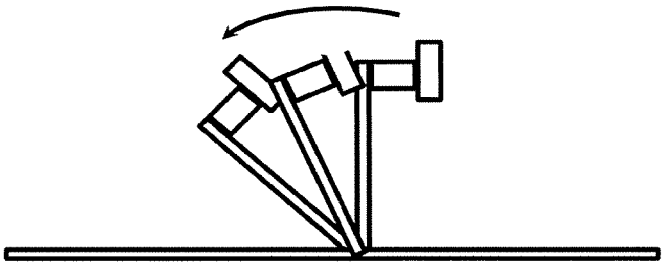
FIG. 1 illustrates a schematic diagram of a first impact action.
Figure 2:
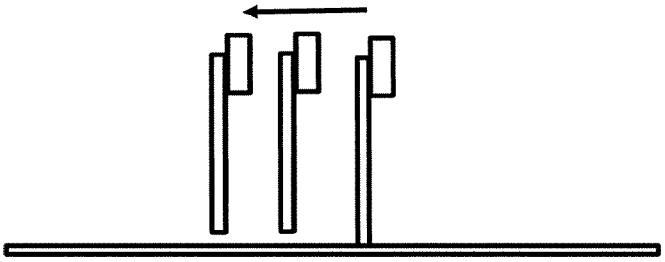
FIG. 2 illustrates a schematic diagram of a second impact action.
Figure 3:
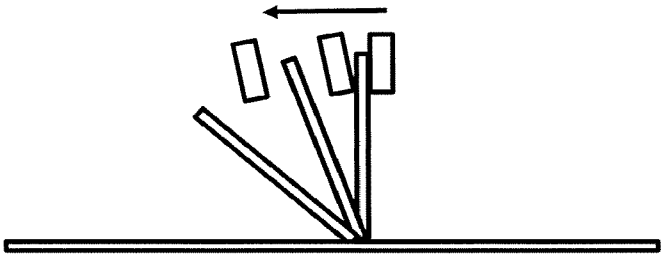
FIG. 3 illustrates a schematic diagram of a third impact action.

As noted above, described herein is a longitudinal beam barrier system that comprises a longitudinal beam and a post linked together via a fastener incorporating at least one deformable washer. The link is made in a releasable and tunable manner dependent on an applied force via the at least one deformable washer. Release may be made dependent on both the magnitude and direction of the force so that release may be a result of different release forces in different force angles. The deformable washer may be designed to transfer a longitudinal beam load force from a fastener to a post wall, the washer extending around the fastener and having a first face that bears on the fastener or a part thereof (or forms part of the fastener) and an opposing face that at least partly bears on a part of the post wall or walls. The washer is designed so that, in the event of an impact of sufficient force on the longitudinal beam, post, or fastener, the washer at least partly deforms allowing separation to occur between the post or posts and the longitudinal beam.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

The terms 'barrier', 'guardrail' and 'longitudinal beam' and grammatical variations thereof as used herein refers to the complete assembly being the longitudinal beam or beams, a post or posts, at least one fastener or fasteners, at least one washer and/or at least one integrated washer and fastener.

The term 'washer' and grammatical variations thereof as used herein refers to a plate with an aperture, the aperture opening defining an inside edge and an outside perimeter defining an outside edge.

The term 'fastener' and grammatical variations thereof as used herein refers to a mechanical linking means that may incorporate the washer as a separate part or the washer may be an integral part of the fastener. For example, the fastener may be a nut and bolt with the washer separately fitted over the bolt shaft. Alternatively, in an integrated embodiment, the washer may form the bolt head or the nut or be integral to the shaft of the bolt and hence is integral to the fastener design. Reference below to a fastener and washer incorporating both separate and integral designs and reference to one embodiment should not be seen as excluding the other embodiment.

The term 'W-beam' and grammatical variations thereof as used herein refers to a W-shape cross-section beam however, unless otherwise noted, reference to a W-beam should not be seen as limiting as other shapes of longitudinal beam, cables or other elements may also be used, examples including box beams, U-channel beams and Thrie beams.

The terms 'aperture', 'opening' and slot' or grammatical variations thereof may be used interchangeably herein and reference to one term should not be seen as excluding the other terms.

In a first aspect, there is provided a barrier system comprising at least one post and a longitudinal beam, the at least one post and longitudinal beam being indirectly linked via at least one fastener and at least one washer wherein the at least one washer comprises:

at least one aperture that receives the at least one fastener therethrough; and at least one deformable region extending at least partly about the aperture that at least partially bears on at least a part of the at least one fastener and an opposing face that bears on at least part of a post wall; and, in the event of an applied force or a displacement being applied on the longitudinal beam or fastener of sufficient magnitude, at least part of the at least one deformable region of the at least one washer deforms to an extent that the indirect link ceases to provide indirect attachment between the post and longitudinal beam, thereby releasing or loosening the connection between the post and longitudinal beam.

In a second aspect there is provided a barrier system post, at least one fastener and at least one washer wherein the at least one washer comprises:

at least one aperture that receives the at least one fastener therethrough; and at least one deformable region extending at least partly about the aperture that at least partially bears on at least a part of the at least one fastener and an opposing face that bears on at least part of a post wall; and, in the event of an applied force or a displacement being applied on the barrier system post of sufficient magnitude, at least part of the at least one deformable region of the at least one washer deforms to an extent that the indirect link ceases to provide indirect attachment of the post and fastener, thereby releasing or loosening the connection between the post and at least one fastener.

In a third aspect there is provided at least one washer for use in a barrier system comprising:

at least one aperture that is sufficiently large to receive at least one fastener therethrough; and at least one deformable region extending at least partly about the aperture that is sized to at least partially bear on either or both of at least a part of the at least one fastener and at least part of a barrier post; and, in the event of a loading or an applied displacement on the barrier system of sufficient magnitude, at least part of the at least one deformable region of the at least one washer deforms to an extent that the bearing face or faces are substantially removed.

In a fourth aspect, there is provided the use of at least one washer substantially as described above in the manufacture of a barrier system.

In a fifth aspect there is provided a method of arresting or re-directing the path of movement of a vehicle by the step of installing a barrier system substantially as described above.

The longitudinal beam holding load may be transferred from the fastener to the post solely through the one or more deformable regions of the at least one washer.

The term 'deformable regions' or grammatical variations thereof refer to a region of the washer that is structurally weaker or lower stiffness relative to another part of the washer. The deformable region may be characterised by having at least one of:

(a) at least one cut out or other weakened part or area;
(b) variable physical size;
(c) variable shape;
(d) variable material strength or elasticity;
(e) variable material treatments; and/or
(f) a designed for failure mode (bending, shear, deformation) that influences the way the washer deforms.

Deformation of the at least one region may be primarily or exclusively plastic deformation although at least some elastic deformation may also occur.

The washer may be an important part of the overall barrier system performance. The properties of this washer may be altered to tune the performance of the washer in order to achieve the desired behaviour of the system. Key variables that may for example be altered on the washer include material properties, thickness, number of cut-outs, size and shape of cut-outs, location of cut-outs, dimensions relative to the aperture in the post, profile of the washer (cupped or flat), symmetry of the washer (both lateral and vertical), shape of the washer (square, round, rectangle, etc). Accordingly the performance of the washer is very tunable for the desired outcome.

The washer may have a circular or semi-circular shape. The use of a circular washer may ensure a consistent performance independent of the orientation of the washer. This makes for an easier installation. Alternatively, other shapes and apertures may be used for the washer that alters the release load or deflection of the system when loaded in different directions or orientations. This can be used to optimise the performance of the system for specific applications.

The washer may be manufactured as a flat surface or it may be cupped so that it fits into at least partially into a post aperture. By varying the cupping of the washer, the degree of clamping friction formed between the washer and the post may be altered. Changing the clamping friction may help tune the force required to move the longitudinal beam relative to the post in the plane of the clamped interface.

As may be appreciated from the above, deformation of the deformable region may be tuned or tailored via many factors. Tailoring (or tuning) of the force needed to cause deformation may be useful for example to ensure a controlled separation at the desired load or displacement and therefore ensure that required safety standards may be met in terms of a light vehicle or heavy vehicle. The system may also be tuned to provide different performances under different types of loads or movements. Further, the system may be tuned for different loads and movements in different directions. This degree of tuning and the various ways this can be achieved may be significant value as it allows considerable system versatility.

The washer may in one embodiment link the longitudinal beam to the post with all linking forces transferred through a single post wall although this is not essential. This single post wall may be the wall closest to the longitudinal beam—herein referred to as the front face. To achieve this, the washer may have a width greater than that of the widest part of the fastener, so that the fastener can move unobstructed through the post aperture on release post washer deformation. Typically this might be the widest part of a nut used in conjunction with a bolt. There may also be additional width on the front face of the post to allow the washer to bear on the rear side of the front face of the post with sufficient area so as to provide a suitable pull out resistance.

The at least one deformable region extending at least partly about the aperture at least partially bears on either side or both sides of at least a part of the at least one fastener and an opposing face that bears on at least part of the first or second member.

In order to prevent the widest part of the fastener from moving behind the front face of the post in a lateral direction, the washer may be sized to ensure it bears on the internal edge of the post and thereby prevent this lateral movement. However, if lateral side to side movement is desired (as noted later) then the shape of the post or the dimension of the washer may be modified accordingly.

Deformation as noted above results in the indirect connection ceasing or loosening. Ceasing or loosening may be a result of the washer and fasteners being drawn through either the longitudinal beam or the post. Alternatively, ceasing or loosening may be a result of the washer detaching from the fastener which in turn allows the post and beam to detach. Equally, it may result in the fastener separating if the deformable region is located within the fastener itself. In more detail, in a separation event, the at least one fastener may be drawn out of the post, the deformed washer and fastener remaining attached to the longitudinal beam and released from the post. Alternatively, the fastener may be drawn out of the washer with the longitudinal beam attached in the event of an impact, the washer remaining located behind the wall of the post. In integrated washer/fastener embodiments, washer deformation may have the equivalent effect of bolt head removal or nut removal using a bolt and nut fastener as an example.

As noted above, the post has an aperture through which the fastener passes. The aperture may be shaped in various ways to suit the desired end design parameters. Reference is made herein to a single post aperture however multi-aperture applications may also be possible and reference to a single aperture should not be seen as limiting. For the purposes of this specification, the term 'aperture' may be used interchangeably with the words detail, hole or opening and refers to a closed hole such as a round shaped hole but may also incorporate part openings or holes, one example being a U-shaped cut-out.

For example, the aperture may have an elongated opening vertically allowing the fastener to move to a predetermined extent in the direction of the elongation before deformation forces are applied to the washer. Vertical movement allowance may be useful to extend the time and lateral deformation that the beam and post remain engaged and therefore optimise the extent that the beam remains at a desired height above the road before being drawn down or released by post rotation caused by a force of sufficient magnitude/impact. Where an elongated slot is used, the fastener may be installed at a low point (at or about the bottom of the slot). During an impact, as the post is required to rotate backwards or move downward, the fastener and the deformable washer used to connect the longitudinal beam to the post may move up the aperture until they impact the top of the aperture. If during this motion a force vector placed on the connection is sufficient, the capacity of the washer will be overcome and the deformable region(s) of the washer will deform thereby allowing the fastener to pull free of the post. This is most likely to occur due to a direct tension force perpendicular to the face of the post (causing both or either of the edges/region sides of the washer to deform) or via a prying action formed between the post and the longitudinal beam (resulting in one edge/region side of the washer deforming prior to the other) or any combination of force vector that results in the capacity of the washer being exceeded. As may be appreciated, the capacity of this system is easily tunable by altering the properties of the washer and the dimensions of the aperture in the post. Properties of the washer that can be tuned are defined more elsewhere but include the shape, thickness, cut out apertures, material properties, method of forming, and so on.

The force or motion applied to the post or fastener may result in the fastener interacting with the post in such a way as to cause the deformable washer to deform. For example, the shape of the top of the post aperture may be formed in any number of ways to control the behaviour of the system. The shape may have a flat or outward radius end allowing the fastener to reach the end of the aperture such that the material on the end of the washer may overlap with material on the front face of the post. Once this occurs, the fastener may then rotate relative to the face of the post due to the moment couple created from the offset between the thickness of the longitudinal beam element and the thickness of the post. This offset can be small for posts and beams with thin wall thicknesses. When the force created by the prying motion exceeds the capacity of the washer, the deformable region(s) of the washer will deform and allow the fastener to separate from the post thereby separating the longitudinal beam from the post element. Effectively, the deformation that occurs in this embodiment is the interaction of the fastener and the post translating a motion or force from a motion or force that does not deform the washer into one that causes it to deform. The top of the post in the example above may for example transfer vertical translation of the washer into rotation and prying movement. This may be an effective way to tune the system for example to delay release or introduce a degree of hysteresis into the system. Equally, in an alternative embodiment, the system can be constructed to undertake the opposite effect, thereby changing the motion or applied force so as to reduce the deformable load applied to the washer.

If the top of the aperture in the post is formed with an alternative shape the alternative shape may limit the potential overlap between the washer and the material in the front face of the post at the top of the aperture and therefore require a lesser force to pry out. Examples of alternative shapes, may comprise: inward radius or serpentine shapes; tabs; and shaped pathways.

The aperture shape may also be formed so as to alter the deformation characteristics of the aperture. For example the aperture may be a T-shaped, X-shaped, wedged shape, key hole, or L-shaped hole and the aperture may therefore have regions where the washer can more easily be pulled through the aperture, for example about the intersection of the L, T or X shape or about regions where the resistance is higher. Shaped aperture may also allow control of the relative motion of two members by the fastener following the shape of the aperture path, e.g. upward and then left.

The post may also have an aperture sized to allow at least one horizontal plane or lateral movement. This may be useful for example to allow for expansion and contraction of the parts caused by high or low temperatures. Lateral movement allowance may also be important to address ribbon tension in the longitudinal beam in the event of an impact. Ribbon tension refers to the tension forces imposed on the beam causing the beam to extend and deflect. Allowing for some lateral movement of the fastener may alter the ribbon tension dynamics minimising the risk of beam failure or rupture whilst also addressing any rotation and/or shear forces imposed on the fastener as the post or posts rotate and move with the beam deflection. As previously noted, in the event of a force of sufficient magnitude on the barrier caused by an errant vehicle, the barrier is required to deflect backwards. This backward motion places the longitudinal beam into tension due to the increase in length required to support the backward motion. An effect of this motion is that the longitudinal beam element may be forced to move towards the point of impact from either side, causing a relative force vector and/or relative lateral movement between the posts and the longitudinal beam. In the case of an impact from the left hand direction, this may place a relative movement (left to right) on the posts upstream of the point of impact and a relative movement of right to left on the downstream posts. As should be appreciated, the opposite relative movement would occur in the case of an impact from the right hand direction. If the dimensions of the deformable washer and the edges of the post are sufficiently tight then this relative movement may be constrained by the washer bearing on the internal edges of the post. However, if sufficient tolerance is provided in either or both lateral directions then this lateral movement may be allowed to occur. Alternatively, the use of a non-symmetric post or non-symmetric apertures or aperture locations may allow movement in one direction only as the washer has no surface to bear against in the other direction.

The bottom of the post aperture may be formed so that it limits the downward motion of the fastener.

This may be achieved with a radius or a flat (square) bottom. Using this form of aperture when the fastener is at the bottom of the aperture/slot allows the washer region to overlap the front face of the post and provides additional resistance to pull-out force in the direction perpendicular to the face of the post and to pull-out forces associated with twisting of the post. If additional pull-out resistance is not required (or not desirable) the bottom of the aperture/slot may be formed with a section of the front face of the post folded inward which therefore prevents the bottom of the washer from overlapping with the front face of the post and ensure that only the side of the washer engages with the post. In this orientation the fastener may be suspended above the bottom of the aperture by the washer being supported by a folded tab.

Many different shapes of post may be used in the barrier system described above given that the design is not reliant on the post sides and post rear (the post side opposing the beam). The post may be of any geometric shape, provided they have a surface that mates to the back of the longitudinal beam section to allow the connection to be formed. This surface may have a sufficient width to allow the connection aperture to be formed in the post. Typically the posts may have the cross sectional shape of an I-beam, C channel, boxed section, U post, Z post, or Σ post. However, other post shapes are also possible.

As noted above, the removal of the fastener from the aperture may be a function of the prying action that is caused on the fastener. This prying action may be a function of the force in the system (F) and the offset between the two points of bearing (L), whereby the prying action can be defined as the product of the two (F x L) called the prying moment (M). By deforming the material at the top of the aperture inward, the offset between the two points of bearing may be increased, thereby reducing the force (F) required to form the prying moment ($M=F\times L$) by increasing the offset distance (L). Furthermore, if the top of the aperture is set-back so as to protrude into the path of the fastener section protruding through the washer, then the amount of material from the deformable washer that overlaps the top of the post may also be controlled thereby providing further ability to tune the performance of the system.

Equally material from other locations along the pathway of the aperture may also be forced inward to interfere with the pathway of the fastener. This may include one or more interference location on one or more sides of the aperture.

A directing means may protrude into the aperture of the post to interfere with motion of the fastener. The directing means may protrude into the top of the aperture of the first or second member. The directing means may prevent the fastener from overlapping with the material on the post. In order to enhance the capacity of the directing means, the directing means may be formed from a material with at least one crease or fold in the length of the material. This crease or fold may significantly increase the directing means capacity to resist the forces applied from the fastener. In one embodiment the directing means may be deformed and creased in a single action thereby making it both economic to manufacture and strong. Other forms are possible to increase the force capacity of the directing means and reference above to a crease form should not be seen as limiting. For example, a separate element may be used (e.g. another fastener) to cause the same effect e.g. the washer and fastener slide up until they hit a second fastener which causes the prying action.

The location of the aperture on the face of the post may be remote from the top of the post(s) and therefore the barrier system performance may be unaffected by damage that may have been caused to the top of the post(s) during manufacturing, handling, or installation. This makes this form of barrier system resilient to damage, an issue which can plague art systems.

The connection formed between the post and the longitudinal beam may use conventional fasteners typical to art barrier systems. This reduces the need for special components and may ease maintenance issues. The at least one fastener may be reusable.

One end of the at least one fastener may be located on the outwards facing side of the longitudinal beam and may have a smooth shape. Outwards refers to the side of the longitudinal beam that a vehicle might impact against. A smooth shape may be preferable as this avoids objects and vehicles snagging or catching on the fastener(s). Ideally the vehicle slides along the longitudinal beam during an impact in order to help redirect and guide the vehicle to safety. It should be appreciated that this orientation is not necessary for the barrier system to work, and alternative orientations of fasteners may be applied.

The at least one fastener may be a bolt with a male thread that threads directly into a nut, the washer abutting the nut or bolt head spending on the bolt orientation relative to the post. The bolt as used above may be an M16 bolt although it should be appreciated that a range of other bolt sizes may be used and the same or similar outcomes achieved. Reference to a bolt should not be seen as limiting as the fastener make take a variety of different forms.

The post may have generally upright/vertical position once driven into the ground. Posts in the assembled form may be spaced at varying distances such as 1, or 1.5, or 2, or 2.5, or 3 metre intervals, or as necessary to locate with the mounting location on the beam.

The overall barrier length may be varied to suit the end application. The barrier as a whole may have terminating ends. The terminating ends may be of varying design to the wider barrier configuration. The terminating ends may incorporate the barrier system described herein to releasably retain the terminal ends or a part thereof.

The longitudinal beam may follow a generally horizontal alignment typically following the road contours and having a constant height above the road commensurate with where a vehicle bumper might impact the longitudinal beam.

The top of each post may terminate about or below the top of the longitudinal beam. This avoids any danger from the posts hitting an impacting object—for example a motorcyclist sliding along the longitudinal beam.

The indirect link described above is described in the context of joining a post to a longitudinal beam element. As should be appreciated, in an alternative embodiment the indirect link could be installed onto an intermediary member such as a block-out component. In this scenario the block-out could be rigidly attached to the post and then the washer used to connect the block-out to the longitudinal beam. This could be a useful option for retrofitting existing barrier systems without removing and replacing the posts. The existing block-outs could simply be removed and replaced with the new block-out containing the washer connection. Equally, the block-out could be rigidly fastened to the longitudinal beam and connected to the post via the deformable connection, or connected to both the beam and post using the deformable connection.

To assemble the barrier, a fastener may be inserted through the longitudinal beam (typically about the mid-section) and the fastener may be threaded through the post aperture, washer and nut before being fixed in place by tightening the nut ensuring that the beam load is transferred cross the fastener region. In the case of an integrated fastener, the washer may for example be a nut or a bolt head and the same method of assembly is used albeit without adding a separate washer. As should be appreciated, installation is relatively simple—drive the post separately, and attach the longitudinal beam. This simple method avoids damage on installation to the connection point as the washer and fastener are fitted after post driving. No or minimal tension exists on the parts prior to tightening of the bolt when assembling and long bolts can be used to help with linking the parts—this can be particularly useful on bends or radii where the longitudinal beam may tend to want to move away from the post location. Further, damage to the top of a post, as may often occur during installation, or variations in thickness of the longitudinal beam (like joining regions or plain regions), do not impact on the performance of the barrier design described herein. Art barriers often can become compromised when damage occurs to the top of the post.

If, after an impact on the barrier from an errant vehicle the connection between the post and the longitudinal beam is damaged, the system can be repaired by simply replacing the deformable washer without needing to replace the post. This is a considerable advantage to the cost of maintaining the system.

Some prior art systems have less tolerance for installation, with either limited vertical tolerance or a lack of rotational tolerance relative between the post and the longitudinal beam. Systems which require a bolt to be inserted directly into threaded hole can be difficult to install, particularly for installations that require variations in horizontal or vertical alignment. The barrier system described herein has tolerance in all directions and is simple to install. The use of a conventional bolt and nut arrangement with a deformable washer (or a system where for example, the bolt head or nut are the washer) will allow the system to be installed using conventional tools and with conventional tolerances without any additional care.

The performance of the system may be very tunable with regards to pull out force and/or pull out displacement. Once designed, the system may be insensitive to tolerances, unlike the art systems which can have significant variations in pull out forces.

The system as described may be insensitive to the location of the connection formed between the post and the longitudinal beam and the splice joints used to connect the individual lengths of longitudinal beam. As noted earlier, the longitudinal beam element may typically be heavily stressed (loaded) during an impact event. The ability to tune the barrier system described herein prevents it from adding additional loads to the longitudinal beam and therefore limits the potential for unwanted failure modes such as tearing or failure of the longitudinal beam. All art systems have specific failure modes that they cannot prevent which can result in additional forces being placed into the longitudinal beam and could result in failure of the longitudinal beam in certain circumstances.

The barrier system as described may also have sufficient tolerance and movement to allow for movement caused by temperature (thermal expansion and contraction). This may be an important characteristic to prevent unwanted structural weakening or breakage.

As may be appreciated, the above described barrier system and aspect of the system may provide a variety of advantages. Some examples include:

(a) The barrier achieves the basic requirements of absorbing at least one force applied on the barrier and redirecting vehicles yet not redirecting too far or in a way that minimises the risk of causing a further hazard;
(b) The design minimises both the number of parts necessary and minimises the need for use of any bespoke or unique parts—in some embodiments the design might only require standard art shaped longitudinal beams, posts and fasteners with specially designed (but low material content, washers as described above). This therefore reduces expense, complexity, transport costs and makes installation simple and fast;
(c) The design allows for a variety of aspects to be tuned prior to installation therefore making the barrier more versatile;
(d) Failure on impact is predictable and reproducible;
(e) In the event of an impact on the barrier, undamaged posts and beams can easily be reassembled by inserting a new washer;
(f) There is little sensitivity in fastener positioning hence the design is easier to install and less prone to failure;
(g) The link between the post and longitudinal beam has no interaction with the top of the post. This means that any damage to the post on installation does not alter the connection and performance on impact of the barrier system;

(h) Movement of the fastener relative to the post and/or longitudinal beam can be allowed for in the design thereby catering also for climate caused changes in position (such as hot or cold weather causing expansion and contraction) and minor impacts where capture and re-direction is unnecessary;

(i) The design also minimises any stress points on the longitudinal beam ensuring that the beam does not fail in the event of an impact;

(j) The system can translate one form of motion or force vector which does not apply a sufficient force to the washer to cause deformation into a second force vector or motion which does apply a force of sufficient strength to deform a region on the washer. Equally, the system can be constructed to undertake the opposite, thereby changing the motion or applied force so as to reduce the deformable load applied to the washer.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as of individually set forth.

WORKING EXAMPLES

The above described barrier system is now described by reference to specific examples. Note that reference is made below to a separate washer however, as noted above, the washer may be integral to the fastener and not a separate item.

Example 1

As noted above, the system comprises of three key components; the longitudinal beam, the posts, and the connection. A general description of the three components is provided below. Please note that these are only provided by way of example.

The Longitudinal Beam

The longitudinal beam 1 is required to form a continuous element along the length of the barrier. It is most commonly manufactured from short lengths of structural section which are joined at regular intervals to form a continuous member. The shape of the longitudinal beam 1 could take many forms, but most commonly for a roadside barrier the longitudinal beam 1 will be a W-beam section, a Thrie beam section, a box beam, or a C channel. Alternatively it could be a cable or wire. Typically the longitudinal beams 1 are provided in lengths of up to 4.2 m and joined together with a bolted connection, either by overlapping the sections or butting the sections together and using a third jointing member.

The longitudinal beam 1 is required to have the necessary structural properties to operate correctly as a barrier whilst also being economic to manufacture, simple to bend for concave and convex corners, whilst also being economic to install. The longitudinal beam 1 typically comes preformed with a mounting slot located at regular intervals. The slots are used to attach the longitudinal beam 1 to the post 2. The slots run longitudinally along the length of the barrier and provide tolerance for the lateral placement of the post 2.

The longitudinal beams 1 are typically off-the-shelf components that are purpose-built for the application. It is desirable to not modify an existing system.

The Posts

The posts 2 are used to provide vertical support to the longitudinal beam 1 at regular intervals so as the beam 1 is at the correct height and to provide resistance to the backward deflection of the longitudinal beam 1 when impacted by a vehicle. Typically the posts 2 are installed directly into the soil by being driven (impacted) into the ground to the desired height. However posts 2 may also be installed by being placed into preformed holes and then compacted around or being encased in concrete. The posts 2 can also be installed onto a hardened surface (concrete, asphalt, etc). This is typically achieved by having a baseplate detail on the bottom of the posts 2 which is then bolted or bonded to the surface.

The post 2 can be of any geometric shape, provided they have a surface that mates to the back of the longitudinal beam 1 section to allow the connection to be formed. This surface must have a sufficient width to allow the connection detail to be formed in the post 2. Typically the posts 2 would have the cross sectional shape of an I-beam, C channel, boxed section, U post, Z post, or F post. However, other post 2 shapes are also possible.

The face of the post 2 that mates with the longitudinal beam 1 section (defined as the front of the post 2) will have a specific detail located in it to form the connection with the longitudinal beam 1. The connection is formed by the fastener 3 and the washer 10 (described in the following section), and the detail on the post 2.

The Fastener and Washer

The connection between the post 2 and the longitudinal beam 1 is formed using a conventional fastener 3 and a specially manufactured deformable washer 10. The fastener 3 could take any form but it is envisaged it would be a conventional bolt and nut arrangement commonly used in barrier applications. It is envisaged that the bolt would be passed through the longitudinal beam 1 and into the post 2. The washer 10 would then be installed on the bolt before the nut is installed and tightened.

Figure 8:
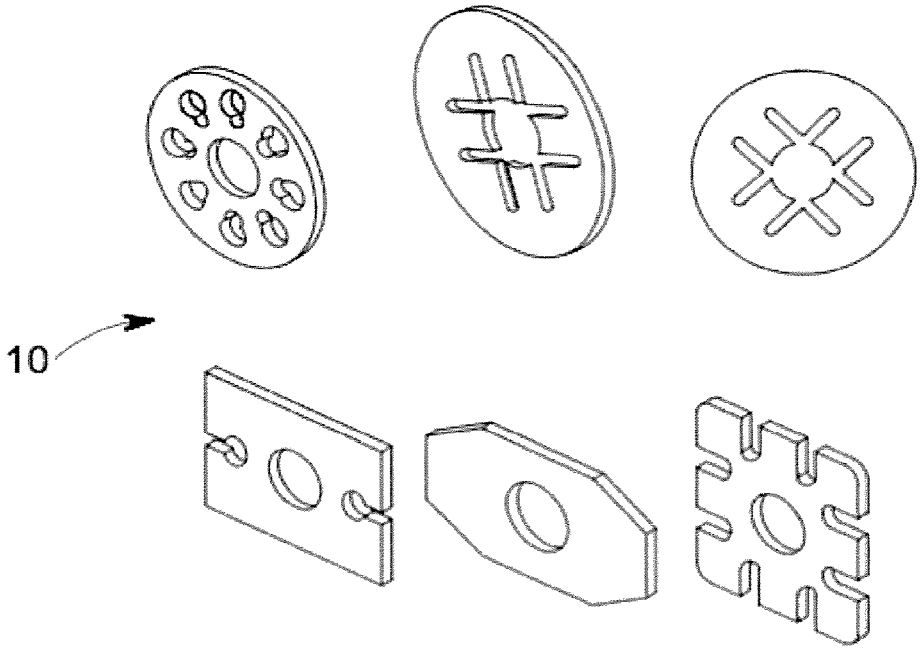
FIG. 8 illustrates embodiments of washer shapes.

The deformable washer 10 is integral to the performance of the system. The properties of this washer 10 can be altered to tune the performance of the washer 10 in order to achieve the desired behaviour of the system. Key variables that could be altered on the washer 10 include material properties, thickness, number of cut-outs, size and shape of cut-outs, location of cut-outs, dimensions relative to the detail in the post 2, profile of the washer 10 (cupped or flat), symmetry of the washer 10 (both lateral and vertical), shape of the washer 10 (square, round, rectangle, etc). Some example washer 10 shapes are shown by way of example in FIG. 8. Accordingly the performance of the washer 10 is very tunable for the desired outcome.

The Connection Detail

Figure 9:
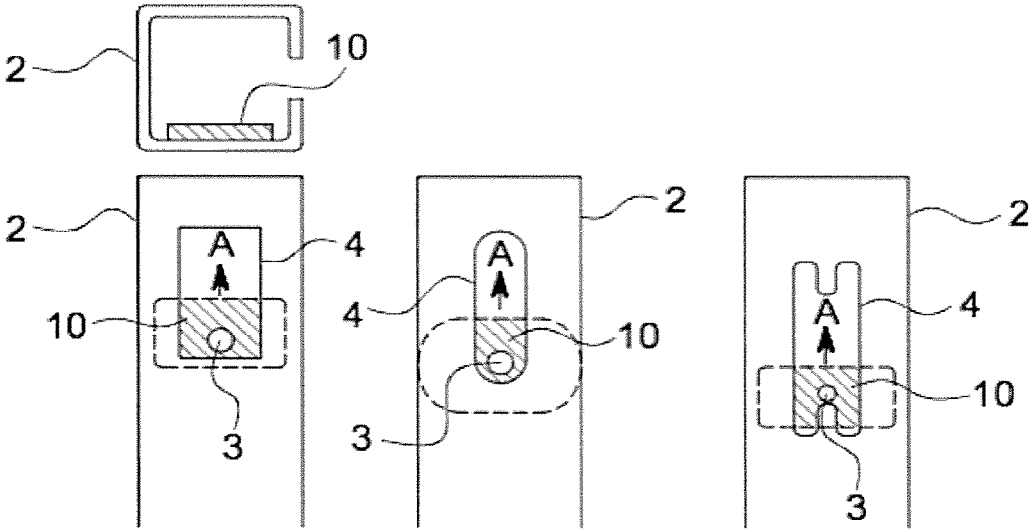
FIG. 9 illustrates alternative connection details in a post (shaded/dotted areas being the deformable washer)

A series of examples are shown in FIG. 9 however these are used for example only and alternative shapes are also possible. The system is formed in the connection detail between the post 2 and the longitudinal beam 1 (not shown for clarity in FIG. 9).

The internal dimension of the post 2 is required to have a width greater than that of the widest part of the fastener 3 that is used in the connector, so that the fastener 3 can move unobstructed through the aperture 4. Typically this would be the widest part of the nut used in conjunction with a bolt (not shown in FIG. 9). There must also be additional width on the front face of the post 2 to allow the deformable washer 10 detail to bear on the rear side of the front face of the post 2 with sufficient area so as to provide a suitable pull out resistance.

In order to prevent the widest part of the fastener 3 directly overlapping with material on the front face of the post 2 (in the example noted this would be the nut on the fastener 3), the deformable washer 10 can be sized to ensure it bears on the internal edge of the post 2 and thereby prevents sufficient lateral movement so as to prevent the nut from engaging with the material on the front face of the post 2. However, if the lateral movement is desired (as noted previously) in either or both directions then the shape of the post 2 or the dimension of the washer 10 can be modified accordingly.

The detail in the post 2 can be formed as an elongated slot (as shown above) to allow the fastener 3 vertical tolerance for installation and to allow the longitudinal beam 1 the ability to move up the post 2 as the post 2 deforms backwards when the system is impacted by an errant vehicle. However, equally the detail could be formed without vertical tolerance and take more of the shape of a hole rather than a slot. Alternatively, the detail could be installed in the post 2 rotated 90 degrees thereby providing the system with movement in the horizontal direction.

Figure 10:
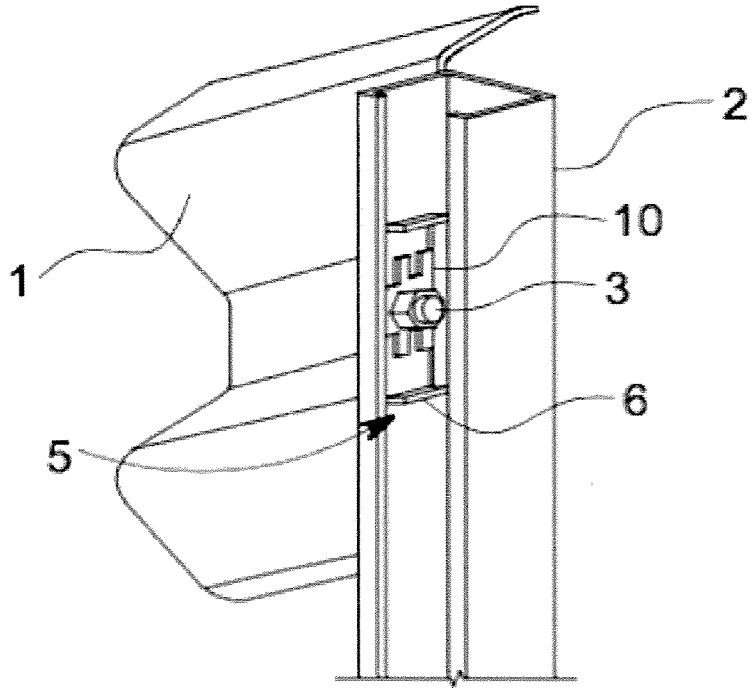
FIG. 10 illustrates a tab at top and bottom of slot embodiment to prevent overlap of the deformable washer with post material when at either end of the slot.

The bottom of the detail can be formed so that it limits the downward motion of the fastener 3. This can be achieved with a radius or a flat (square) bottom. Using this form of detail when the fastener 3 is at the bottom of the slot the washer 10 detail overlaps the front face of the post 2 and provides additional resistance to pull-out force in the direction perpendicular to the face of the post 2 and to pull-out forces associated with twisting of the post 2. If additional pull-out resistance is not required (or not desirable) the bottom 5 of the slot 4 can be formed with a section 6 of the front face of the post 2 folded inward as shown in FIG. 10 which therefore prevents the bottom of the washer 10 from overlapping with the front face of the post 2 and ensure that only the side of the washer 10 engages with the post 2. In this orientation the fastener 3 is suspended above the bottom of the aperture 4 by the washer 10 sitting on the folded tab section 6.

During an impact, as the post 2 is required to rotate backwards, the fastener 3 and the deformable washer 10 used to connect the longitudinal beam 1 to the post 2 can move up the detail in the post 2 until they impact the top of the detail. If during this motion the force vector placed on the connection is sufficient the release capacity of the washer 10 will be overcome and the edge or edges of the washer 10 will deform thereby allowing the fastener 3 to either pull free of or loosen its grip on the post 2. This is most likely to occur due to a direct tension force perpendicular to the face of the post 2 (causing both edges of the washer 10 to deform) or a prying action formed between the post 2 and the longitudinal beam 1 (resulting in one edge of the washer 10 deforming prior to the other) or any combination of force vector or imposed displacement that results in the capacity of the washer 10 being exceeded. As can be imagined, the capacity of this system is easily tunable by altering the properties of the washer 10 and the dimensions of the detail in the post 2. Properties of the washer 10 that can be tuned are defined more elsewhere but include the shape, thickness, cut out details, material properties, method of forming, etc. The prior art examples shown (with the exception of the system in U.S. Pat. No. 7,878,486 cannot achieve these forms of release mechanism and are purely related to a vertical release mechanism)

At the top of the post 2 aperture 4 detail, the shape can be formed in any number of ways to control the behaviour of the system. If the shape has a flat or outward radius end then the fastener 3 will impact the end of the detail and the washer 10 will overlap with the front face of the post 2. Once this occurs, the fastener 3 will then rotate relative to the face of the post 2 due to the moment couple created from the offset of the thickness of the longitudinal beam 1 element and the thickness of the post 2. When the force created by the prying motion exceeds the capacity of the washer 10, the deformable regions of the washer 10 will deform and allow the fastener 3 to separate from the post 2 thereby separating the longitudinal beam 1 from the post 2 element.

If the top of the post 2 aperture 4 detail in the post 2 is formed with an alternative shape it can limit the potential overlap between the washer 10 and the material in the front face of the post 2 at the top of the detail and therefore reduce the force to pry out. Examples of alternative shapes, such as in inward radius or serpentine shape are shown in FIG. 9.

Figure 11:
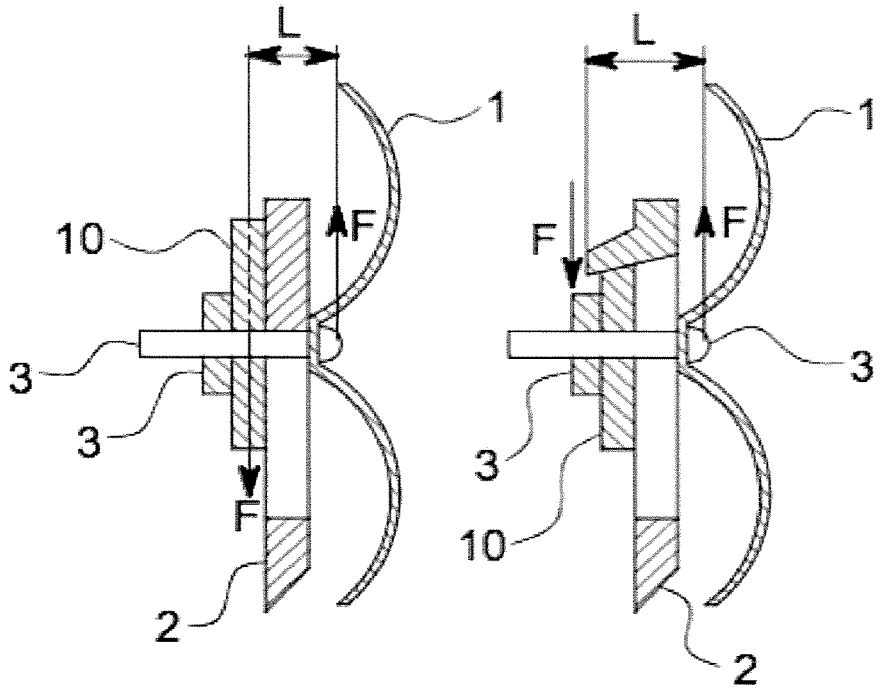
FIG. 11 illustrates side views of an assembled post and beam illustrating the prying action resulting on a bolt with and without an upper tab (beak)

As noted above, the removal of the fastener 3 from the slot 4 is primarily a function of the prying action that is caused on the fastener 3. As shown in FIG. 11, this prying action is a function of the force in the system (F) and the offset between the two points of bearing (L), whereby the prying action can be defined as the product of the two (F x L) called the prying moment (M). By deforming the material at the top of the detail or slot 4 inward, the offset between the two points of bearing can be increased, thereby reducing the force (F) required to form the prying moment ($M=F \times L$) by effectively increasing the offset length (L). Furthermore, if the top of the detail 4 is set-back so as to protrude into the path of the fastener 3 then the amount of material from the deformable washer 10 that overlaps the top of the post 2 can also be controlled thereby providing further ability to tune the performance of the system.

Figure 12:
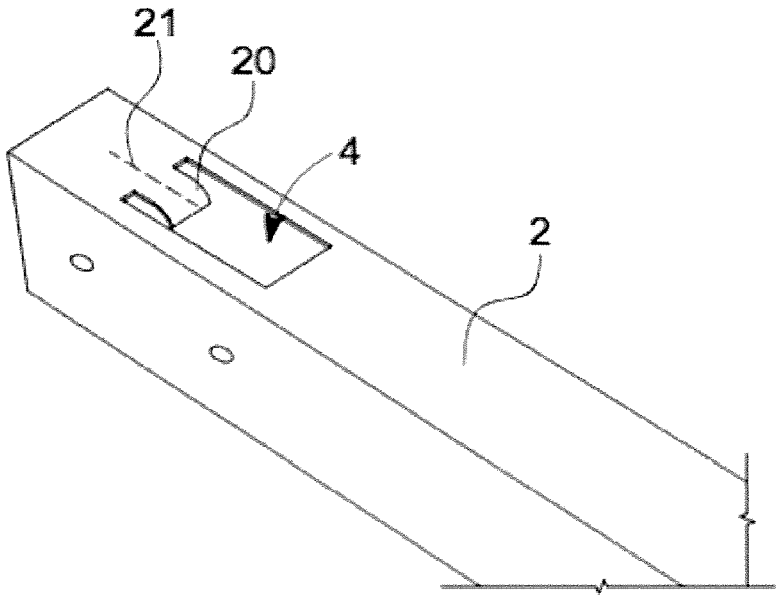
FIG. 12 illustrates an image showing the post detail and aperture with an upper tab including a crease to form a protruding beak.

When directing means 20, shown in FIG. 12 as a beak 20, protrudes into the post 2 at the top of the detail 4 to interfere with the motion of the fastener 3, it is subjected to a high impact force which can result in the directing means 20 bending rather than providing the desired restraining force. In order to enhance the capacity of this directing means 20 it can be formed with at least one crease, fold, rib or other detail 21 down the length of the directing means 20, an example being that shown in FIG. 12. This crease 21 places a fold into the directing means 20 and significantly increases its capacity to resist the forces applied from the fastener 3. In one embodiment, the directing means 20 is manufactured by deformation and creasing 21 in a single action thereby making it both economic to create and strong.

As previously noted, during an impact caused by an errant vehicle the barrier is required to deflect backwards. This backward motion places the longitudinal beam 1 into tension due to the increase in length required to support the backward motion. An effect of this motion is that the longitudinal beam 1 element is forced to move towards the point of impact from either side, causing a relative force vector and/or relative lateral movement between the posts 2 and the longitudinal beam 1. As drawn, this places a relative movement (left to right) on the posts 2 upstream of the point of impact and a relative movement of right to left on the downstream posts 2 resulting from an impact occurring from the left hand direction. If the dimensions of the deformable washer 10 and the edges of the post 2 are sufficiently tight then this relative movement can be constrained by the washer 10 bearing on the internal edges of the post 2. However, if sufficient tolerance is provided in either or both lateral directions then this lateral movement can be allowed to occur. Alternatively, the use of a non-symmetric post 2, a non-symmetric aperture 4 detail, or a non-symmetric washer 10, it can allow movement in one direction only as the washer 10 has no surface to bear against in the other direction.

Figure 13:
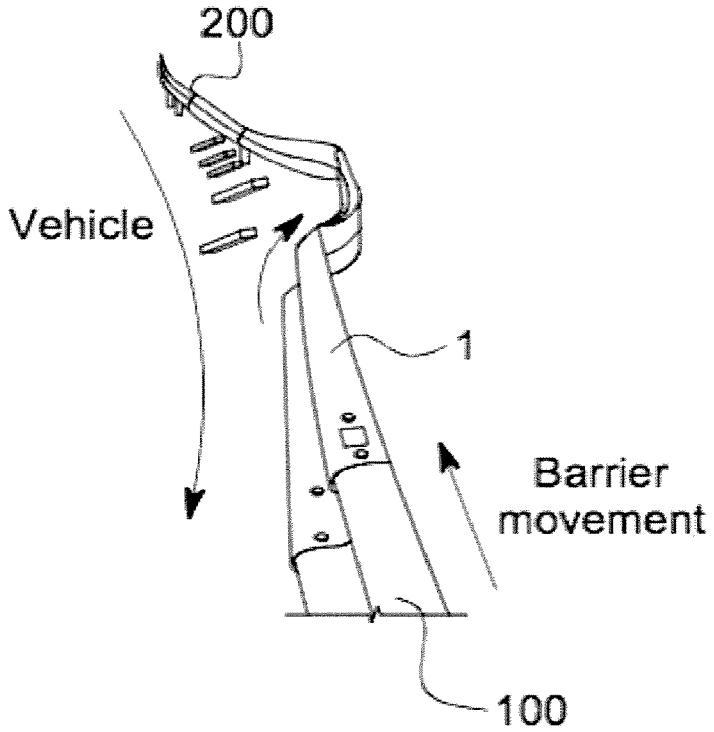
FIG. 13 illustrates the relative movement of a longitudinal beam and posts upstream and downstream of an impact.
Figure 14:
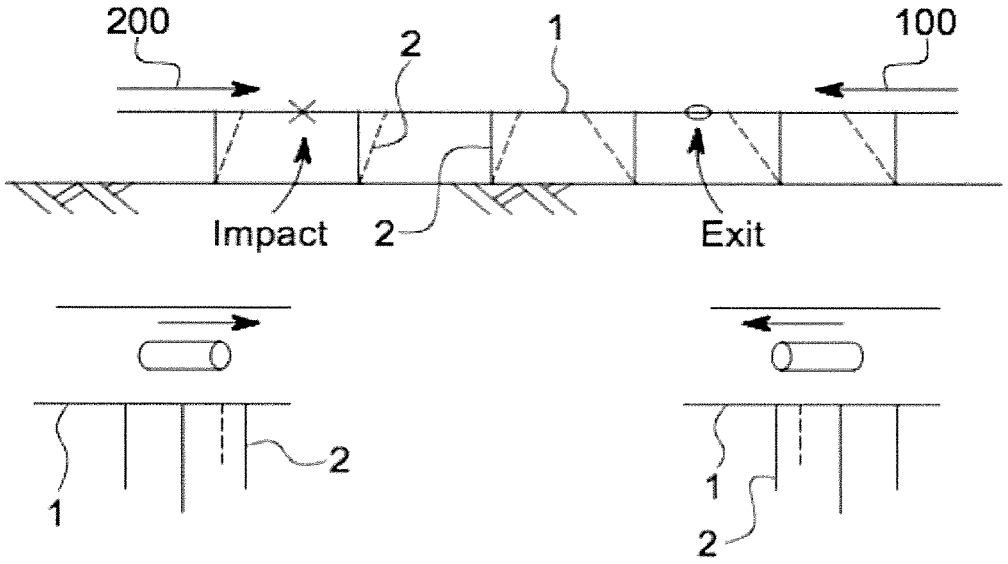
FIG. 14 illustrates alternative views of the relative movement of a longitudinal beam and posts upstream and downstream of an impact from FIG. 13.
Figure 19:
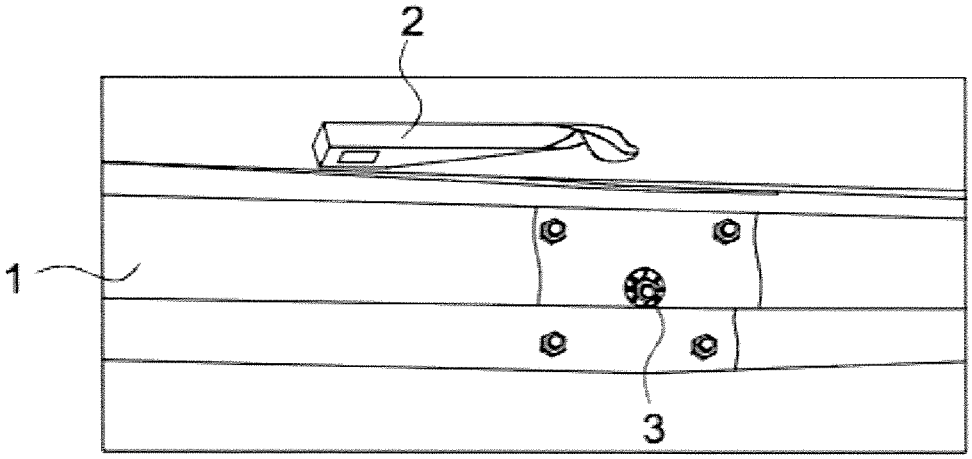
FIG. 19 illustrates an image from a first side of a post and beam after separation and deformation of the washer caused by post rotation and twisting during impact.
Figure 20:
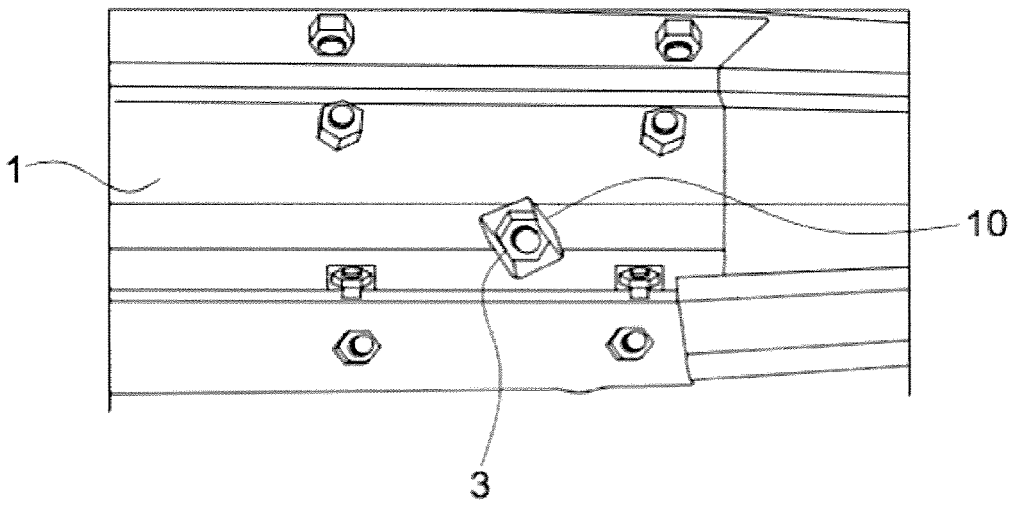
FIG. 20 illustrates an image from the opposing side of a post and beam after separation and deformation of the washer caused by post rotation and twisting during impact.
Figure 21:
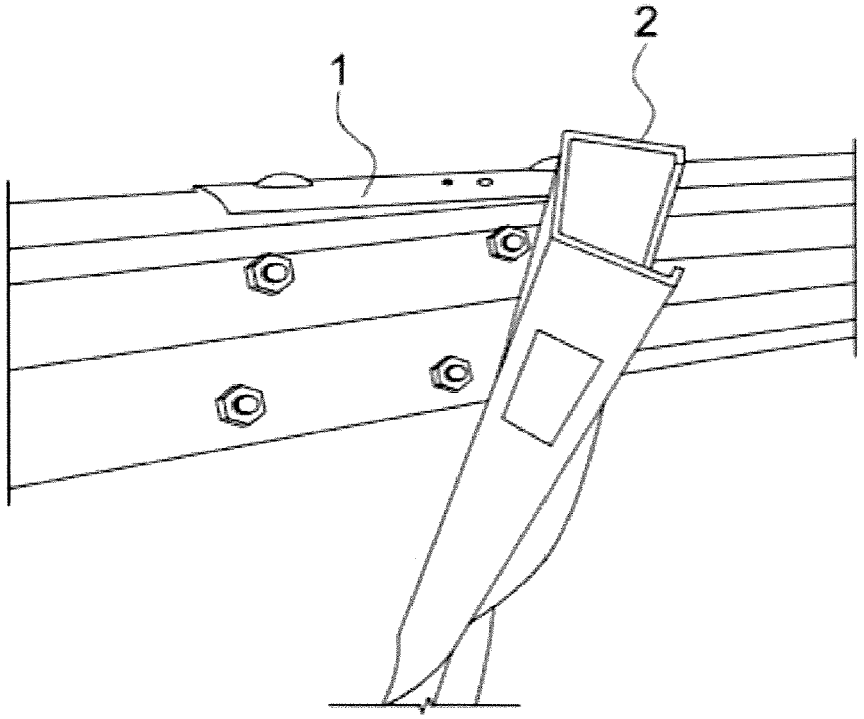
FIG. 21 illustrates a further different view of a post and beam after separation and deformation of the washer caused by post rotation and twisting during impact.
Figure 22:
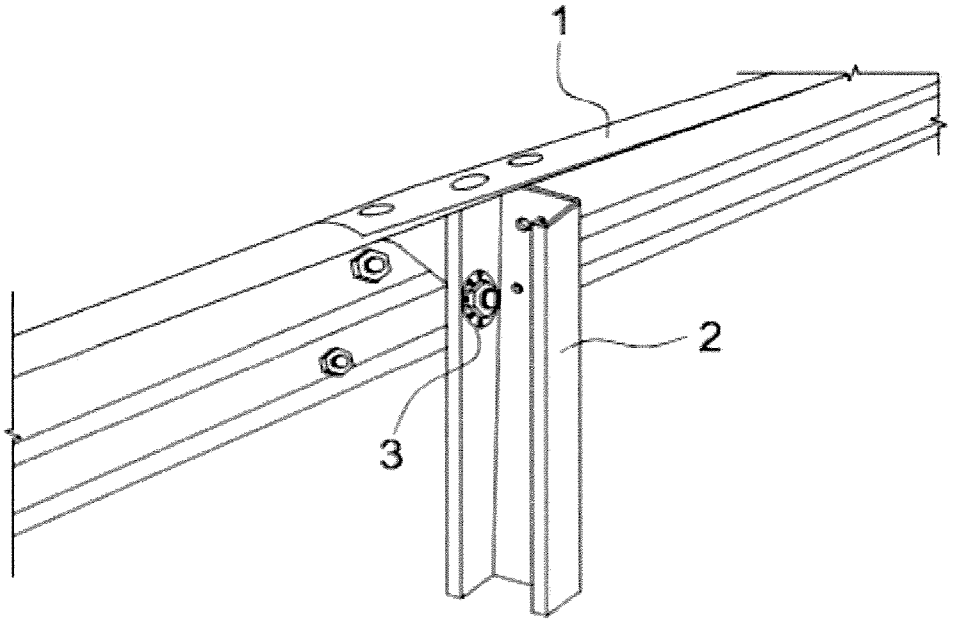
FIG. 22 illustrates a post and beam located at a distance from the impact zine illustrating the deformable washer still retaining the post and beam together but where the beam has moved upward to the top of the post and begun to deform.

Experience has shown that the optimal performance of a barrier system may be obtained by retaining the connection between the post 2 and the longitudinal beam 1 for all posts 2 upstream from the point of impact—see FIG. 22 for example—while allowing the posts 2 downstream to disconnect from the longitudinal beam 1 thereby preventing the longitudinal beam 1 from being dragged downward as the posts 2 are deflected—see FIGS. 19-21 for example. In this circumstance, the different relative lateral movement of the longitudinal beam 1 to the posts 2 in the upstream and downstream directions can be used to provide an increased resistance to release force upstream and downstream. If the shape of the post 2 is chosen which provides restrain to the washer 10 in one direction and not the other, such as an I-beam with a web towards one side of the flange and not the other, or the detail 4 on the post 2 is offset laterally to prevent movement in one direction and not the other, then the system can be tuned to provide different release loads between the system upstream 100 and downstream 200 from the point of impact, as shown in FIG. 13 and FIG. 14.

The use of a circular deformable washer 10 ensures a consistent performance independent of the orientation of the washer 10. This makes for an easier installation. Alternatively other shapes and details can be used for the washer 10 that alters the release load or deflection of system when loaded in different directions or orientations. This can be used to optimise the performance of the system for specific applications.

Figure 15:
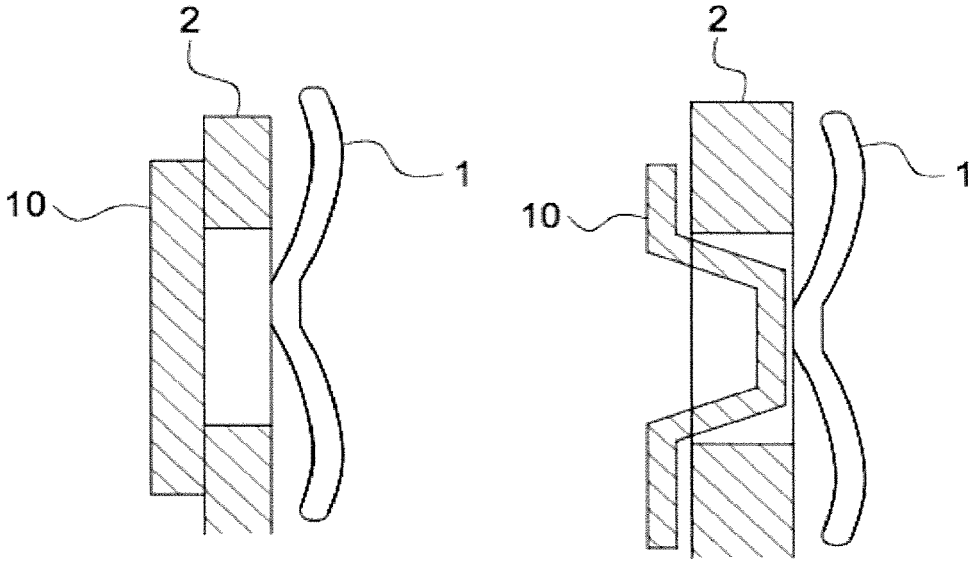
FIG. 15 illustrates side views of examples of flat and cupped washer shapes.

The washer 10 can be manufactured as a flat surface or it can be cupped so that it fits into the detail formed in the post 2 and bears directly on the back surface of the longitudinal beam 1 element, or somewhere in between. Examples of flat and cupped washers 10 are shown in FIG. 15. By varying the cupping of the washer 10 the degree of friction formed between the washer 10 and the post 2 can be altered. Changing the clamping friction can help tune the force required to move the longitudinal beam 1 relative to the post 2 in direction of the interface plane. Additionally, changing the external dimensions of the washer 10 can result in differing degrees of relative movement required between the washer 10 and the post 2 prior to the beam 1 being released. A washer with a larger perimeter will require a greater relative movement prior to a release being formed.

The location of the detail on the face of the post 2 is remote from the top of the posts 2 and therefore its performance will be unaffected by damage that may have been caused to the top of the posts 2 during installation. This makes this form of release mechanism resilient to damage, an issue which plagues the art systems. Furthermore the connection formed between the post 2 and the longitudinal beam 1 can use conventional fasteners typically used in this form of construction. This reduces the need for special components and eases maintenance issues.

If, after an impact on the barrier from an errant vehicle the connection detail between the post 2 and the longitudinal beam 1 is damaged, the system can be repaired by simply replacing the deformable washer 10 detail without needing to replace the post 2. This is a considerable advantage to the cost of maintaining the system.

Figure 16:
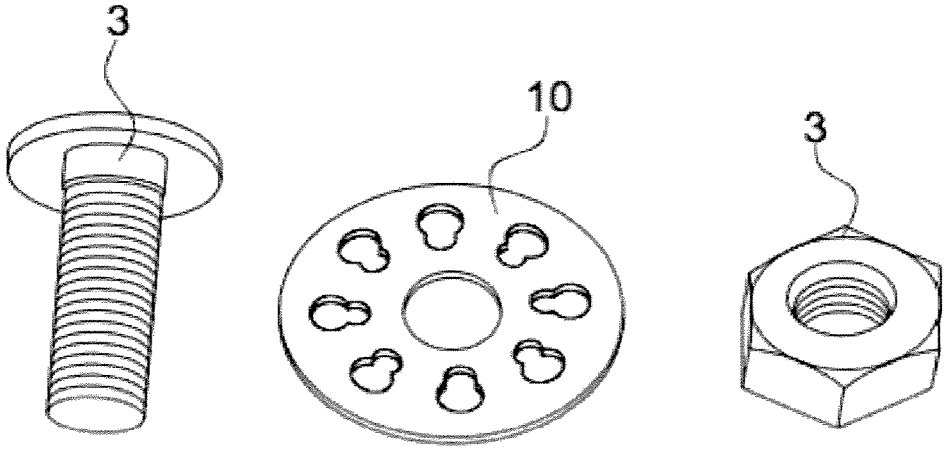
FIG. 16 illustrates an exploded view showing an example of use of a conventional nut and bolt fastener along with a washer defined herein.
Figure 17:
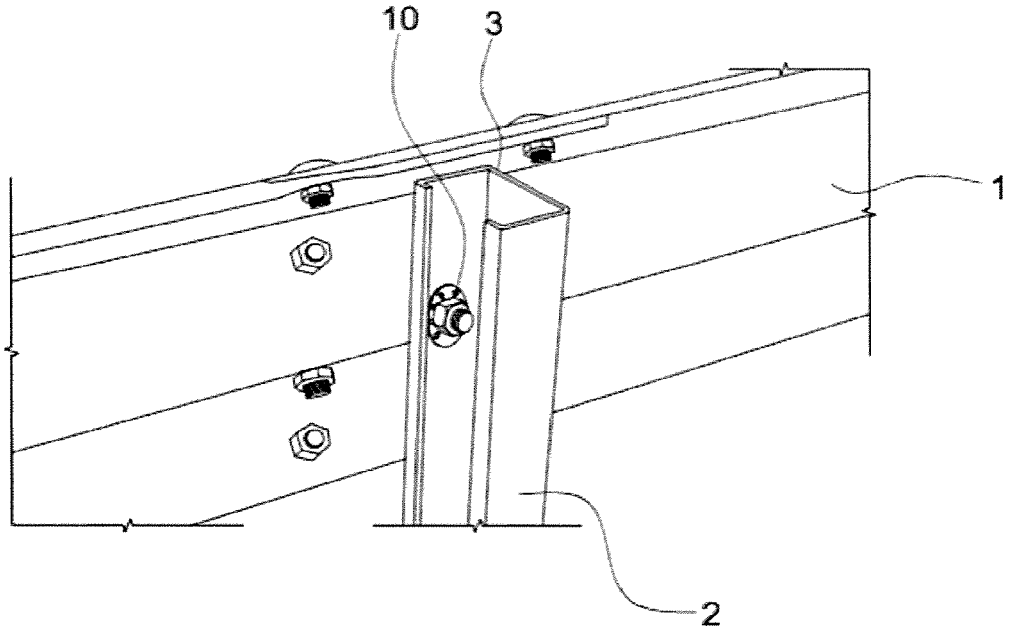
FIG. 17 illustrates an embodiment of an installation with upper tab (beak) detail on the post providing a prying action on bolt to assist with release forces.
Figure 18:
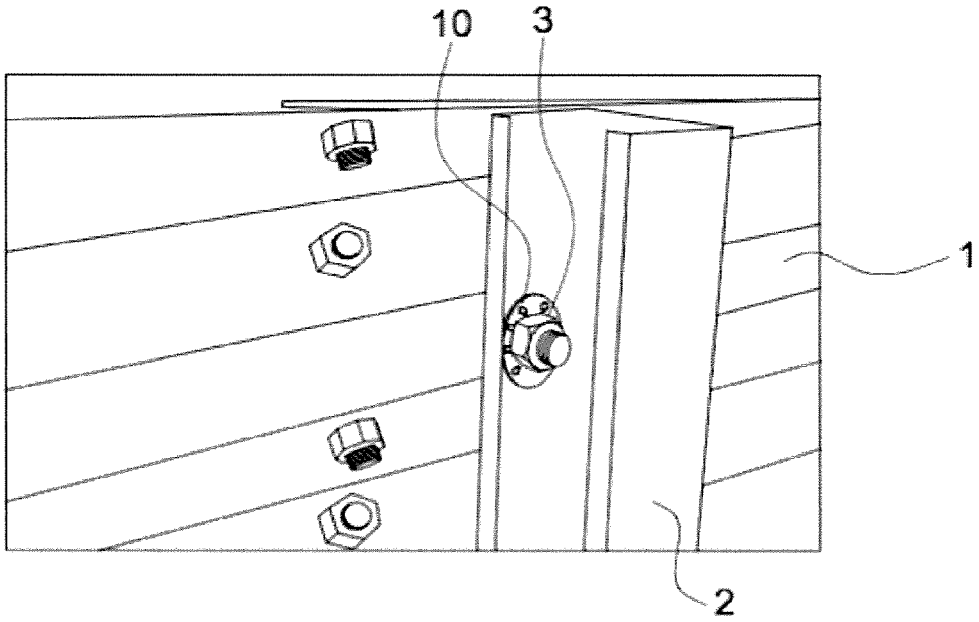
FIG. 18 illustrates an alternative view of the typical installation embodiment of FIG. 17.

Some art systems have less tolerance for installation, with either limited vertical tolerance or a lack of rotational tolerance relative between the post 2 and the longitudinal beam 1. Systems which require a bolt to be inserted directly into threaded hole can be difficult to install, particularly for installations that require variations in horizontal or vertical alignment. The barrier system described herein has tolerance in all directions and is simple to install. The use of a conventional bolt and nut arrangement with a deformable washer 10 (shown in FIG. 16) allows the system to be installed using conventional tools and with conventional tolerances without any additional care. In addition, there is sufficient tolerance for the system to allow for thermal expansion and contraction.

The performance of the system is very tunable with regards to pull out force and/or pull out displacement. Once designed, the system is insensitive to tolerances, unlike the system in U.S. Pat. No. 7,878,486 which has significant variations in pull out forces depending on where the system is located in to the slot of the w-beam.

The system as described is insensitive to the location of the connection formed between the post 2 and the longitudinal beam 1 and the splice joints used to connect the individual lengths of longitudinal beam 1. As noted earlier, the longitudinal beam 1 element is typically heavily stressed (loaded) during an impact event. The ability to tune the barrier system described herein prevents it from adding additional loads to the longitudinal beam 1 and therefore limits the potential for unwanted failure modes such as tearing or failure of the longitudinal beam 1. All other systems have specific failure modes that they cannot prevent which can result in additional forces being placed into the longitudinal beam 1 and could result in failure of the longitudinal beam 1 in certain circumstances.

As noted above, the novel connection detail can be used with a variety of post 2 shapes. It can also be used in a back-to-back longitudinal beam 1 configuration (defined as a median configuration) with longitudinal beam 1 installed on both sides of a post 2. It an can also be used with block-outs installed between the post 2 and the rail, with the deformable connection used either between the rail and the blockout or the blockout and the post 2. When installed in a back to back configurations, this could have block-outs on one, both, or no-sides.

The detail described above has been used to join a post 2 to a longitudinal beam 1 element. Alternatively the detail could be installed onto a block-out component. In this scenario the block out could be rigidly attached to the post 2 and then the washer 10 and detail 4 used to connect the block-out to the longitudinal beam 1. This could be a useful option for retrofitting existing barrier systems without removing and replacing the posts 2. The existing block-outs could simply be removed and replaced with the new block-out containing the washer 10 connection detail. It an can also be used with the deformable connection between the block-out and the post 2, thereby separating the block-out and post 2 when released. In a back to back configuration, the system could be installed with block-outs on one side, both siders or with no block-outs.

The information contained above shows the connection detail located on the post 2 with a simple aperture 4 or slot located on the longitudinal beam 1. The system would work equally with the connection detail on the longitudinal beam 1 and a simple connection point on the post 2. Likewise, the connection could be tuned 90 degrees (or any other angle) and could be used to provide a releasing mechanism with tolerance for lateral movement (or movement in any direction). Furthermore, the connection could be formed with the detail on both the rail and post 2, with the details angularly separated so as to provide variable releasing forcing under varying applied loads in all directions.

Aspects of the barrier system have been described by way of example only and it should be appreciated that modifications and additions may be made thereto without departing from the scope of the claims herein.

What is claimed is:

1. A barrier system comprising at least one post and a longitudinal beam, the at least one post and longitudinal beam being indirectly linked via at least one fastener passing through apertures in the at least one post and longitudinal beam, and at least one washer, the post aperture being elongated to allow vertical movement of the at least one fastener within the post aperture; wherein the at least one washer comprises:

at least one aperture that receives the at least one fastener therethrough; and at least one deformable region extending at least partly about the aperture that at least partially bears on at least a part of the at least one fastener and an opposing face that bears on at least part of a post wall; and, in the event of an applied force or a displacement being applied on the longitudinal beam or fastener of sufficient magnitude, the at least one fastener and at least one washer attached to the at least one fastener moves to a predetermined extent in the direction of the elongation in the post aperture before deformation forces are applied to the at least one washer, and, at least part of the at least one deformable region of the at least one washer deforms during movement or when the at least one fastener and at least one washer impact the top of the post aperture to an extent that the indirect link ceases to provide indirect attachment between the post and longitudinal beam, thereby releasing or loosening the connection between the post and longitudinal beam.

2. The barrier system as claimed in claim 1 wherein the longitudinal beam holding load is transferred from the fastener to the post solely through the one or more deformable regions of the at least one washer.

3. The barrier system as claimed in claim 1 wherein the washer has a circular or semi-circular shape.

4. The barrier system as claimed in claim 1 wherein the washer is manufactured as a flat surface or is cupped to fit at least partially into an aperture in the post aperture.

5. The barrier system as claimed in claim 1 wherein the washer has a width greater than that of the widest part of the fastener so that the fastener can move unobstructed through the post aperture on release post washer deformation.

6. The barrier system as claimed in claim 1 wherein deformation results in the indirect connection ceasing or loosening, ceasing or loosening being a result of the washer and fastener(s) being drawn through the post.

7. The barrier system as claimed in claim 1 wherein deformation results in the indirect connection ceasing or loosening, ceasing or loosening being a result of the washer and fastener(s) being drawn through the longitudinal beam.

8. The barrier system as claimed in claim 1 wherein deformation results in the indirect connection ceasing or loosening, ceasing or loosening being a result of the washer detaching from the fastener which in turn allows the post and beam to detach.

9. The barrier system as claimed in claim 1 wherein deformation results in the indirect connection ceasing or loosening, ceasing or loosening being a result of the fastener itself separating if a deformable region is located within the fastener itself.

10. The barrier system as claimed in claim 1 wherein releasing or loosening the connection between the at least one post and longitudinal beam occurs at least partially as a result of a prying action formed between the top of the elongated slot in the post and the at least one washer.

11. The barrier system as claimed in claim 1 wherein the top of the post aperture is formed to cause the at least one washer to deform.

12. The barrier system as claimed in claim 11 wherein the shape has a flat or outward radius end allowing the fastener to reach the end of the detail such that the material on the end of the washer overlaps with material on the front face of the post and once this occurs, the fastener then rotates relative to the face of the post due to the moment couple created from the offset between the thickness of the longitudinal beam and the thickness of the post.

13. The barrier system as claimed in claim 1 wherein the bottom of the post aperture is formed so that it limits the downward motion of the fastener.

14. The barrier system as claimed in claim 1 wherein the post has a cross sectional shape of an I-beam, C channel, boxed section, U post, Z post, or L post.

15. The barrier system as claimed in claim 1 wherein a directing means protrudes into the aperture of the post to interfere with the motion of the fastener.

16. The barrier system as claimed in claim 15 wherein the directing means protrudes into the top of the aperture of the post to interfere with the motion of the fastener, preventing the fastener from overlapping with the material on the front face of the post.

17. The barrier system as claimed in claim 15 wherein the directing means is formed from a material with at least one crease or fold in the length of the material.

18. The barrier system as claimed in claim 1 wherein the aperture on the face of the post is remote from the top of the post.

19. The barrier system as claimed in claim 1 wherein the at least one fastener is inserted through the longitudinal beam at least one aperture and into the at least one post aperture, the washer and nut then being installed ensuring that the longitudinal beam load onto the post is transferred across the washer/fastener using standard components and no bespoke or unique parts.

20. The barrier system as claimed in claim 1 wherein the at least one fastener is installed at a low point at or about the bottom of the elongated post aperture.

21. The barrier system as claimed in claim 1 wherein, during an impact/imposed force, the post and/or longitudinal beam is required to rotate backwards or move downward and the at least one fastener and the at least one washer used to connect the longitudinal beam to the post moves up the post aperture until they impact the top of the post aperture.

22. The barrier system as claimed in claim 1 wherein the top of the elongated post aperture transfers vertical translation movement of the at least one washer into rotation and prying movement.

23. The barrier system as claimed in claim 1 wherein the top of the elongated post aperture is formed with a shape that limits the overlap between the at least one washer and material in the front face of the post at the top of the elongated post aperture.

24. The barrier system as claimed in claim 23 wherein the shape is selected from: inward radius or serpentine shapes, tabs, and shaped pathways.

25. The barrier system as claimed in claim 1 wherein the post aperture shape is shaped to alter the deformation characteristics of the post aperture.

26. The barrier system as claimed in claim 25 wherein the post aperture shape is T-shaped, X-shaped, wedge shaped, key hole shaped, or L-shaped.

27. The barrier system as claimed in claim 1 wherein the top of the post aperture is shaped to have a flat or outward radius end detail and, when the fastener impacts the end of the detail, the at least one washer will overlap with the front face of the post and will then rotate relative to the face of the post due to the moment couple created from the offset of the thickness of the longitudinal beam and the thickness of the post and, when the force created by the prying motion exceeds the capacity of the at least one washer, the deformable regions of the at least one washer will deform and allow the at least one fastener to separate from the post thereby separating the longitudinal beam from the post.

28. A barrier system post, at least one fastener passing through at least one aperture in the barrier system post and at least one washer, the post aperture being elongated to allow vertical movement of the at least one fastener within the post aperture; wherein the at least one washer comprises:

at least one aperture that receives the at least one fastener therethrough; and at least one deformable region extending at least partly about the aperture that at least partially bears on at least a part of the at least one fastener and an opposing face that bears on at least part of a post wall; and, in the event of an applied force or a displacement being applied on the barrier system post of sufficient magnitude, the at least one fastener and at least one washer attached to the at least one fastener moves to a predetermined extent in the direction of the elongation in the post aperture before deformation forces are applied to the at least one washer, and, at least part of the at least one deformable region of the at least one washer deforms during movement or when the at least one fastener and at least one washer impact the top of the post aperture to an extent that the indirect link ceases to provide indirect attachment of the post and fastener, thereby releasing or loosening the connection between the post and at least one fastener.

29. A method of arresting or re-directing the path of movement of a vehicle by the step of installing a barrier system comprising at least one post and a longitudinal beam, the at least one post and longitudinal beam being indirectly linked via at least one fastener passing through apertures in the at least one post and longitudinal beam, and at least one washer, the post aperture being elongated to allow vertical movement of the at least one fastener within the post aperture; wherein the at least one washer comprises:

at least one aperture that receives the at least one fastener therethrough; and at least one deformable region extending at least partly about the aperture that at least partially bears on at least a part of the at least one fastener and an opposing face that bears on at least part of a post wall; and, in the event of an applied force or a displacement being applied on the longitudinal beam or fastener of sufficient magnitude, the at least one fastener and at least one washer attached to the at least one fastener moves to a predetermined extent in the direction of the elongation in the post aperture before deformation forces are applied to the at least one washer, and, at least part of the at least one deformable region of the at least one washer deforms during movement or when the at least one fastener and at least one washer impact the top of the post aperture to an extent that the indirect link ceases to provide indirect attachment between the post and longitudinal beam, thereby releasing or loosening the connection between the post and longitudinal beam.

30. The barrier system as claimed in claim 1 wherein the deformable washer is a separate part.

31. The barrier system as claimed in claim 30 wherein the fastener is a nut and bolt with the deformable washer separately fitted over the bolt shaft.

32. The barrier system as claimed in claim 1 wherein the deformable washer is an integral part of the fastener.

33. The barrier system as claimed in claim 32 wherein the washer forms the bolt head.

34. The barrier system as claimed in claim 32 wherein the washer forms the nut.

35. The barrier system as claimed in claim 32 wherein the washer is integral to the shaft of the bolt.

* * * * *